US010273731B2

(12) United States Patent
Dries

(10) Patent No.: US 10,273,731 B2
(45) Date of Patent: Apr. 30, 2019

(54) DOOR CONSTRUCTION WITH SLIDEABLE PIVOT HINGE

(71) Applicant: RUBELKO, Schilde (BE)

(72) Inventor: Rudi Dries, Schilde (BE)

(73) Assignee: RUBELKO, Schilde (BE)

( * ) Notice: Subject to any disclaimer, the term of this patent is extended or adjusted under 35 U.S.C. 154(b) by 264 days.

(21) Appl. No.: 15/512,105

(22) PCT Filed: Sep. 18, 2015

(86) PCT No.: PCT/IB2015/057199
§ 371 (c)(1),
(2) Date: Mar. 17, 2017

(87) PCT Pub. No.: WO2016/042525
PCT Pub. Date: Mar. 24, 2016

(65) Prior Publication Data

US 2018/0355650 A1 Dec. 13, 2018

(30) Foreign Application Priority Data

Sep. 18, 2014 (BE) ..... 2014/0709

(51) Int. Cl.
*E05F 1/04* (2006.01)
*E05F 1/12* (2006.01)
(Continued)

(52) U.S. Cl.
CPC ..... *E05F 1/1253* (2013.01); *E05D 7/04* (2013.01); *E05D 7/081* (2013.01);
(Continued)

(58) Field of Classification Search
CPC ..... E05F 1/1253; E05F 1/1246; E05F 1/129; E05F 3/104; E05F 3/10; E05F 3/20;
(Continued)

(56) References Cited

U.S. PATENT DOCUMENTS 987,467 A * 3/1911 Katzenberger ..... E05D 3/00 16/281
1,007,523 A * 10/1911 Brucker ..... E05F 3/104 16/281
(Continued)

FOREIGN PATENT DOCUMENTS

DE 3228703 A1 2/1984
KR 20100061024 A 6/2010

*Primary Examiner* — Chuck Y Mah
(74) *Attorney, Agent, or Firm* — Browdy and Neimark, PLLC

(57) ABSTRACT

The invention provides a door construction comprising a door panel and at least one pivot hinge for rotatably suspending the door panel in a door opening. The at least one pivot hinge is integrated into the door panel at the top side or at the bottom side of the door panel. The door panel comprises a guide profile, extending along substantially the entire side of the door panel having the at least one pivot hinge. The at least one pivot hinge is slidably arranged in the guide profile, and the at least one pivot hinge is provided with attachment means for releasably attaching the at least one pivot hinge to the guide profile.

23 Claims, 13 Drawing Sheets

(51) Int. Cl.
*E05D 7/04* (2006.01)
*E05D 11/10* (2006.01)
*E05D 7/081* (2006.01)

(52) U.S. Cl.
CPC ..... *E05D 11/1014* (2013.01); *E05D 11/1064* (2013.01); *E05F 1/1292* (2013.01); *E05Y 2900/132* (2013.01)

(58) Field of Classification Search
CPC .... E05F 3/225; E05F 3/227; E05Y 2201/638; E05Y 2800/268; E05Y 2900/132; E05Y 2600/452; E05Y 2600/41; E05D 7/04; E05D 7/081; E05D 7/084; E05D 7/086; E05D 7/10; E05D 11/104; E05D 11/1064; Y10T 16/552; Y10T 16/5525; Y10T 16/56; Y10T 16/593; Y10T 16/2769; Y10T 16/2771; Y10T 16/2774; Y10T 16/283; Y10T 16/304; Y10T 16/53826; Y10T 16/53836; Y10T 16/5384; Y10T 16/53848
See application file for complete search history.

(56) References Cited

U.S. PATENT DOCUMENTS 1,518,220 A * 12/1924 Petrie ..... F16C 33/102 16/273
1,653,448 A * 12/1927 Bommer ..... E05D 11/1064 16/284
1,959,325 A * 5/1934 Anderson ..... E05F 3/108 16/51
2,035,823 A 3/1936 Moore
2,063,818 A * 12/1936 Mankinen ..... A61H 15/00 601/121
2,700,175 A * 1/1955 Carlson ..... E05F 1/1253 16/284
3,063,086 A * 11/1962 Calhoun ..... E05F 3/222 16/49
3,325,942 A 6/1967 Bejarano
3,444,830 A 5/1969 Doetsch
3,657,766 A * 4/1972 Peterson ..... E05D 3/022 16/281
4,000,540 A * 1/1977 Newlon ..... E05F 1/1253 16/298
4,640,046 A * 2/1987 Rushford ..... E05D 15/02 49/141
4,821,373 A * 4/1989 Maidment ..... E05D 1/00 16/227
6,161,255 A 12/2000 Garrett
7,305,796 B2 * 12/2007 Chiang ..... E05D 5/0246 16/252
7,594,302 B2 * 9/2009 Balenzano ..... E05D 5/0246 16/252
8,528,169 B1 * 9/2013 Yu ..... E05D 7/043 16/238
8,578,556 B1 * 11/2013 Yu ..... E05F 3/227 16/240
9,095,214 B2 * 8/2015 White ..... E05F 1/1253
2005/0050685 A1 3/2005 Chen
2005/0177975 A1 * 8/2005 Wang ..... E05F 1/1292 16/60
2007/0246945 A1 10/2007 Chiang
2008/0127452 A1 * 6/2008 Jackson ..... E05F 1/1253 16/50
2011/0219583 A1 * 9/2011 Bacchetti ..... E05D 11/1014 16/54
2012/0311817 A1 * 12/2012 Bacchetti ..... E05F 3/104 16/51
2013/0185896 A1 * 7/2013 Yu ..... E05F 3/104 16/55

* cited by examiner

DOOR CONSTRUCTION WITH SLIDEABLE PIVOT HINGE

TECHNICAL FIELD

The present invention relates to a door construction, particularly for an inside door or an outside door, to be mounted in a wall opening, provided with a pivot hinge that is slidably arranged in the door panel. The present invention further relates to a self-closing pivot hinge to be slidably arranged in a door panel, particularly the door panel of an inside door or an outside door, to be mounted in a wall opening.

PRIOR ART

The pivot hinges for doors known in the art are arranged at least partly in a recess provided thereto in one of the sides of the door's door panel. Said recess is arranged along a part of the respective side, or at a corner of the door panel. Such pivot hinges are known from, among others, US 2007/0246945 A1 and U.S. Pat. No. 6,161,255 A.

However, a disadvantage of such door constructions is that the pivot hinges are built into the door panel at a predetermined position, i.e. the position in the door panel where the recess for arranging the pivot hinge therein is provided. In other words, it is not possible to freely determine the position of the pivot hinge when installing the door construction. This means that the axis about which the door panel will pivot or rotate is established beforehand, and therefore cannot be adjusted to the conditions of use of the door. If the door panel is required to rotate about another axis, a door panel is to be provided with a pivot hinge arranged in a recess at a position suitable thereto.

DESCRIPTION OF THE INVENTION

An aim of the present invention is to provide a door construction wherein the door panel is provided with at least one slideable pivot hinge affording a greater freedom for selecting the position of the pivot axis or rotational axis of the door panel.

The invention thereto provides a door construction comprising a door panel and at least one pivot hinge for rotatably suspending the door panel in a door opening, wherein the at least one pivot hinge is integrated into the door panel at a side of the door panel selected from the top side of the door panel and the bottom side of the door panel, wherein the door panel comprises a guide profile extending along substantially the entire side of the door panel that is provided with the at least one pivot hinge, said at least one pivot hinge being slidably arranged in said guide profile, and wherein said at least one pivot hinge is provided with attachment means for releasably attaching the at least one pivot hinge to the guide profile.

The door construction according to the present invention offers the advantage that the position of the at least one pivot hinge along the respective side (the side provided with the at least one pivot hinge) is more freely selectable, since the at least one pivot hinge is slideable through the guide profile, with the possibility to attach the pivot hinge at a plurality of selectable positions by means of the attachment means provided thereto. For a door panel of standard dimensions, for example, one may opt to place the at least one pivot hinge at an extreme position against an edge of the door panel, so that in cooperation with a rotation axis element or optionally an additional pivot hinge at a side of the door panel opposite the side of the door panel in question, a rotational axis is formed at said edge of the door panel, about which the door panel can rotate. For wider door panels, one may opt to place the pivot hinge at a position at a certain distance of the edge of the door panel, such as at one third of the length of the guide profile. This reduces the work required from the at least one pivot hinge to rotate the door panel about the rotational axis.

The attachment means and the slidability of the at least one pivot hinge offer the advantage that the position where the at least one pivot hinge is attached in the guide profile can be accurately adjusted. This ensures that the at least one pivot hinge is accurately alignable with a rotation axis element or optionally an additional pivot hinge at the opposite side of the door panel. Thus, a rotational axis may be defined that is well aligned vertically, about which the door panel can rotate when opening and closing the door panel, which can reduce wear and prolong the life span of the pivot hinge(s).

The door construction according to the present invention is also advantageous for maintenance and/or repairs to parts of the door construction, since the at least one pivot hinge is easily releasable from the guide profile and the at least one pivot hinge—once released—is slideable in the guide profile. The door panel can then easily be removed from the door opening by sliding it in relation to the pivot hinge(s), until the hinge(s) exit(s) the guide profile(s). It is therefore not necessary to release the pivot hinge(s) itself/themselves in the wall opening; they can remain fixed in place to the respective parts of the floor or the upper frame. This way, different parts of the door construction can undergo maintenance and/or repair separately and easily. The guide profile extending along substantially the entire side of the door panel into which the at least one pivot hinge is integrated, offers the advantage that the at least one pivot hinge can be implemented with a housing arranged in the guide profile in a lengthwise direction and extending lengthwise therein. This allows the lever arm with which the pivot hinge engages the guide profile to be enlarged, thus reducing the amount of force to be exerted by the at least one pivot hinge to rotate the door panel about the rotational axis, which may reduce wear and prolong the life span of the pivot hinge(s).

The guide profile is preferably arranged with an access opening extending along substantially the entire length of the guide profile, preferably along the entire lengthwise direction of the guide profile. This offers the advantage that the at least one pivot hinge is readily accessible through the access opening when the at least one pivot hinge is already positioned in the guide profile. This is advantageous, for instance, when installing the door construction according to the present invention, to still be able to move the at least one pivot hinge in the guide profile when it hasn't yet been attached therein using the attachment means.

The attachment means, and/or optionally other means for adjusting the at least one pivot hinge, such as for example the adjustment means for springs in the at least one pivot hinge discussed below, are preferably arranged to also be accessible through the access opening of the guide profile. This offers the advantage that the at least one pivot hinge can easily be attached in the guide profile and/or can be adjusted when the at least one pivot hinge has already been positioned in the guide profile.

Preferably, the access opening is sized to allow the insertion and removal of the at least one pivot hinge into/out of the guide profile through the access opening. This offers the advantage that the at least one pivot hinge is easily arrangeable in the guide profile and easily removable from the guide profile, for instance when installing the at least one pivot hinge in the guide profile or when replacing a malfunctioning at least one pivot hinge.

Preferably, the access opening is arranged at a side of the guide profile facing away from the door panel where the at least one pivot hinge is integrated into the door panel. This offers the advantage that the access opening is not visible from the outside in the door construction according to the present invention.

In an embodiment of the door construction according to the present invention, the door construction comprises a first pivot hinge and a second pivot hinge for rotatably suspending the door panel in the door opening, wherein the first pivot hinge is integrated into the door panel at the top side of the door panel and, there, is slidably arranged in a first guide profile, wherein the second pivot hinge is integrated into the door panel at the bottom side of the door panel and, there, is slidably arranged in a second guide profile, and wherein the first pivot hinge and the second pivot hinge are provided with attachment means for releasably attaching the first pivot hinge to the first guide profile and for releasably attaching the second pivot hinge to the second guide profile.

Having a pivot hinge integrated both at the top side of the door panel and at the bottom side of the door panel allows the forces necessary for rotating the door panel about the rotational axis to be supplied by two pivot hinges instead of a single pivot hinge. This allows the use of less powerful pivot hinges. This is decidedly advantageous when using larger and/or heavier door panels, in which case the pivot hinges bear a heavier load.

In an embodiment of the door construction according to the present invention, the at least one pivot hinge is a self-closing pivot hinge comprising:

- an elongated housing, arranged in the lengthwise direction in the guide profile, and adapted to slide through the guide profile;
- a rotation column, adapted to be attached to a wall of the door opening opposite the respective side of the door panel into which the at least one pivot hinge is integrated, wherein the housing is mounted rotatably around the rotation column, so that the housing is rotatable in relation to the rotation column from a closed position, in which the door panel closes the door opening, in a first direction to a first open position, and/or in a second direction, opposite to the first direction, to a second open position;
- a first spring, extending in the housing along the lengthwise direction of the housing and conferring a self-closing function to the at least one pivot hinge;
- a cam member, being part of the rotation column, and a first spherical ball, being urged against the cam member by means of the first spring, wherein the cam member is shaped to provide support positions in which the first ball rests when the door panel is in the open and closed positions, and wherein the first ball, under the influence of the spring pressure from the first spring, is urged, from substantially every position other than the support positions, in the direction of the support position corresponding to the closed position of the door panel.

The inventors have found that the at least one pivot hinge, provided as such, is a highly advantageous way to provide a self-closing pivot hinge.

On the one hand, the elongated housing offers the advantage that the housing, and with it the pivot hinge, can extend in the lengthwise direction of the guide profile. This enlarges the lever arm with which the at least one pivot hinge engages in the guide profile, thus reducing the amount of force to be exerted by the at least one pivot hinge to rotate the door panel about the rotational axis. Furthermore, this force is also distributed inside the housing over a larger surface. This will limit wear and prolong the life span of the pivot hinge.

On the other hand, the elongated housing also offers the advantage that sufficient space can be provided inside the housing to allow the arrangement of the first spring in the lengthwise direction of the housing.

The use of a spherical ball allows the contact surface between the ball and other parts of the at least one pivot hinge, such as, among others, the cam member and the housing, to remain small, which can be advantageous with regard to wear of the ball and those parts of the at least one pivot hinge that are in contact with the ball. The small contact surface between the ball and said other parts is also advantageous in limiting friction between the ball and said other parts, which is beneficial for the smooth operation of the at least one pivot hinge of the door construction according to an embodiment of the present invention. The inventors have also found that when repeatedly rotating the housing around the rotation column, the ball will not always roll over the cam member with the same part of its surface. The orientation of the ball in relation to the cam member will thus change over time. This is advantageous with regard to wear of the ball, since it is not always the same part of the ball that is subjected to a load.

In an embodiment of the door construction according to the present invention, the at least one pivot hinge further comprises:

- a second spring, extending inside the housing along the lengthwise direction of the housing, wherein the first and second springs are located at opposite sides of the rotation column; and
- a second spherical ball, being urged against the cam member by means of the second spring, wherein the cam member is further shaped to provide support positions in which the second ball rests when the door panel is in the open and closed positions, and wherein the second ball, under the influence of the spring pressure from the second spring, is urged, from substantially every position other than the support positions, in the direction of the support position corresponding to the closed position of the door panel.

The use of the second spring offers the advantage that, compared to a single spring, more force can be exerted on the cam member for rotating the door panel about the rotational axis of the door panel. This allows more powerful pivot hinges to be provided, which are advantageous to be used in door constructions with larger and/or heavier door panels.

As a result of the second spring and the second ball being positioned on the side of the rotation column opposite from the side of the rotation column where the first spring and the first ball are positioned, the cam member is furthermore loaded symmetrically. This offers the advantage that the forces exerted on the cam member are distributed more evenly over the cam member, which can limit wear to the cam member.

In an embodiment of the door construction according to the present invention, the housing is shaped to provide a first sliding surface and a second sliding surface; said sliding surfaces being provided to slide over complementary sliding surfaces in the lengthwise direction and over substantially the entire length of the guide profile when sliding the at least one pivot hinge in the guide profile.

The sliding surfaces on the housing, combined with the complementary sliding surfaces in the guide profile, allow the housing, and with it the at least one pivot hinge, to be slidably arrangeable in the guide profile, by means of a simple construction. This reduces the complexity of the at least one pivot hinge.

Preferably, the first sliding surface and the second sliding surface are provided at opposite sides of the housing, which sides are also positioned along the lengthwise direction of the housing. This ensures that the housing is firmly supported at both sides in the guide profile, which is advantageous for a stable positioning of the at least one pivot hinge in the guide profile.

In an embodiment of the door construction according to the present invention, the cam member is a body comprising a first face and a second face, positioned opposite each other, and a mantle surface connecting the first face and the second face, wherein the support positions corresponding to the open positions of the door panel are provided by two notches at opposite positions on the mantle surface of the cam member, wherein for the first ball, the support position corresponding to the closed position of the door panel is provided by a first recess on the first face of the cam member, and wherein for the second ball, if present, the support position corresponding to the closed position of the door panel is provided by a second recess on the second face of the cam member.

The cam member as such is shaped as a flattened body, such as for example a disc, a square plate or a hexagonal plate. The inventors have found that having the cam member in such a shape is very advantageous for providing the support positions corresponding to the closed and open positions of the door panel, and is also very advantageous for providing the self-closing function of the at least one pivot hinge.

When the door panel is in the first open position, the first ball rests in a first notch in the mantle surface. If a force is then exerted on the door panel in the direction of the closed position of the door panel, the door panel rotates from the first open position to the closed position. Herein, the housing of the at least one pivot hinge rotates around the rotation column of the at least one pivot hinge, and the first ball in the housing rolls over the cam member. First, the first ball rolls out of the first notch in the mantle surface. Then, the ball briefly rolls over the mantle surface, to subsequently roll over the corner between the mantle surface and the first face of the cam member. From then on, the first ball rolls on the first face, where no force is required anymore on the door panel to further rotate the door panel to the closed position. From then on, the spring force of the first spring pressing against the first ball ensures that the first ball rolls up to and into the first recess in the first face of the cam member, where the door panel is in the closed position.

If the door panel is then rotated further, by means of a force exerted on the door panel in the direction of the second open position, from the closed position to the second open position, the ball rolls out of the first recess, in the direction opposite to the direction from which the first ball rolled into the first recess when rotating the door panel from the first open position to the closed position. Then, the first ball rolls further over the first face of the cam member over the corner between the first face and the mantle surface. Finally, the first ball briefly rolls over the mantle surface up to and into the second notch in the mantle surface, said second notch being positioned opposite the first notch in the mantle surface.

If a second ball is also present, said second ball rests in the second notch in the mantle surface when the door panel is in the first open position. The first ball and the second ball thus each rest in one of the two opposing notches in the mantle surface when the door panel is in the first open position. When rotating the door panel from the first open position to the closed position, the second ball rolls via the second face of the cam member up to and into the second recess in the second face of the cam member, while the first ball, as described above, rolls via the first face up to and into the first recess in the first face. When rotating the door panel from the closed position to the first open position, the second ball then rolls out of the second recess in the second face, over the second face and the mantle surface, up to and into the first notch in the mantle surface, while the first ball, as described above, rolls via the first face and the mantle surface up to and into the second notch in the mantle surface.

The first recess in the first face of the cam member, and, if the second ball is present, the second recess in the second face of the cam member, are preferably arranged for allowing the first ball and the second ball, respectively, to be partially lowered therein. This offers the advantage that the first ball, and, if the second ball is present, the second ball are firmly secured in the first recess and the second recess, respectively. As a result of this, the door panel is retained in the closed position in a more stable manner when the door panel is in the closed position, and the door panel will also move more easily into the closed position when the door panel is being moved from the first open position or the second open position.

In an embodiment of the door construction according to the present invention, the first face of the cam member, and, if the second ball is present, the second face of the cam member, are provided as a convex surface in the direction extending along the support positions on the mantle surface of the cam member.

As a result of this, the cam member is thinner at the edges positioned in the proximity of the part of the mantle surface where the first notch and the second notch in the mantle surface are arranged, and thicker in the central part in the proximity of the first recess in the first face. When the first ball, while rotating the door panel from the first open position or the second open position to the closed position, rolls over the first face in the direction of the first recess in the first face, the cam member will then gradually thicken. As a result of this, the first spring will be lightly compressed, compared with how much the first spring would be compressed when using a flat first face. This light compression of the first spring ensures that the rolling movement of the first ball, and therefore also the rotating movement of the door panel, will be lightly slowed down when the door panel approaches the closed position. As a result of this, the door panel will close softly in the closed position. The door panel is also prevented from overshooting the closed position, and therefore closing with an oscillating movement. It should be evident that the same reasoning also applies to the second face of the cam member, if the second ball is present.

As a result of the convex surface, the angle between the first face and the mantle surface is also greater compared to a flat first face. This makes the transition for the first ball between the mantle surface and the first face more gradual, which is advantageous with regard to wear of the cam member and the first ball. It should be evident that the same reasoning also applies to the second face of the cam member, if the second ball is present.

The direction extending along the support positions on the mantle surface of the surface, is the direction along which the first ball rolls over the first face of the cam member, and the direction along which the second ball, if present, rolls over the second face of the cam member, when the housing rotates around the rotation column when rotating the door panel between the open and closed positions. This direction is approximately perpendicular to the direction of the rotational axis of the housing of the at least one pivot hinge and of the door panel, wherein said rotational axis extends through the cam member. This direction extends from the left side of the cam member to the right side of the cam member, and thus is the horizontal direction of the cam member.

In an embodiment of the door construction according to the present invention, the first face of the cam member, and, if the second ball is present, the second face of the cam member, is provided as a concave surface in the direction substantially perpendicular to the direction extending along the support positions on the mantle surface of the cam member.

As a result of this, the cam member is thinner at its center, meaning near the line extending along the support positions on the mantle surface, than it is at its top side and at its bottom side. The cam member being thicker at the bottom side and at the top side is advantageous for the sturdiness of the cam member. The thinner central part, on the other hand, offers advantages for the self-closing operation of the at least one pivot hinge. As a result of the cam member being thinner, a larger spring path is provided for the first spring at the transition from the mantle surface to the first face, since the distance over which the first ball and the first spring can move through the housing when the first ball rolls from the mantle surface to the first face, is enlarged as the cam member is made thinner at its center. As a result of this, the first spring can supply a greater force for rotating the door panel to the closed position, compared to a thicker cam member. It should be evident that the same reasoning also applies to the second face of the cam member, if the second ball is present.

The direction substantially perpendicular to the direction extending along the support positions on the mantle surface of the cam member, is the direction substantially parallel to the direction of the rotational axis of the housing of the at least one pivot hinge and of the door panel, which rotational axis extends through the cam member. This direction extends from the top side of the cam member to the bottom side of the cam member, and thus is the vertical direction of the cam member.

In an embodiment of the door construction according to the present invention, the first recess is arranged so that the first ball is capable of being lowered into the first recess until halfway through the cam member, and, if the second ball is present, the second recess is arranged so that the second ball is capable of being lowered into the second recess until halfway through the cam member.

As a result of the first ball being capable of being lowered into the first recess until halfway through the cam member, the spring path which the spring can cover between the open positions of the door panel, in which the first ball is located in one of the notches on the mantle surface of the cam member, and the closed position of the door panel, in which the first ball is located in the first recess, is enlarged. As a result of this, the first spring can exert a greater force for rotating the door panel to the closed position, compared to a cam member provided with a first recess in which the first ball is capable of being lowered less deeply than until halfway through the cam member. As a result of the first ball being capable of being lowered into the first recess only until halfway through the cam member, the cam member still retains enough sturdiness to be able to resist the forces exerted by the first spring on the cam member by way of the first ball. It should be evident that the same reasoning also applies, mutatis mutandis, to the second recess in the second face of the cam member, if the second ball is present.

If a second ball is present, it is decidedly advantageous to arrange the first recess and the second recess in such a way that both the first ball and the second ball are capable of being lowered until halfway through the cam member. As a result of this, both the first ball and the second ball can be maximally lowered into the cam member, without the first ball and the second ball pressing against each other when located in the first recess and the second recess, respectively.

In an embodiment of the door construction according to the present invention, the first recess is provided at its circumference with a first support surface for the first ball, and, if the second ball is present, the second recess is provided at its circumference with a second support surface for the second ball.

The first support surface at the circumference of the first recess on the first face of the cam member offers the advantage that the first ball is well supported from different directions when the first ball is located in the first recess. This reduces the risk of the first ball shifting in the first recess. The first ball is therefore supported in a more stable manner in the first recess. As a result of this, the door panel is maintained in the closed position in a stable manner by means of the at least one pivot hinge of the door construction according to an embodiment of the present invention. It should be evident that this also applies, mutatis mutandis, to the second support surface at the circumference of the second recess on the second face of the second cam member, if the second ball is present.

In an embodiment of the door construction according to the present invention, the first support surface has a shape which is complementary to the shape of the first ball, and, if the second ball is present, the second support surface has a shape which is complementary to the shape of the second ball.

The first support surface at the circumference of the first recess on the first face of the cam member is, then, shaped to be complementary to the shape of the part of the first ball that supports on the first support surface when the first ball is located in the first recess. As a result of this complementary shape of the first support surface, the freedom of movement of the first ball is limited even further when said first ball is located in the first recess, which offers the advantage of an even more stable positioning of the door panel in the closed position by means of the at least one pivot hinge of the door construction according to an embodiment of the present invention. It should be evident that the same reasoning also applies, mutatis mutandis, to the second support surface at the circumference of the second recess on the second face of the second cam member, if the second ball is present.

In an embodiment of the door construction according to the present invention, the transition between the first face and the mantle surface of the cam member in the proximity of the support positions on the mantle surface is provided with a transition surface to facilitate the transition of the first ball between the first face and the mantle surface, and, if the second ball is present, the transition between the second face and the mantle surface of the cam member in the proximity of the support positions on the mantle surface is provided with a transition surface to facilitate the transition of the second ball between the second face and the mantle surface.

The transition surface is advantageous for preventing wear to the cam member from the first ball rolling over the corner between the mantle surface and the first face, and if the second ball is present, from the second ball rolling over the corner between the mantle surface and the second face.

The transition surface is also advantageous for rotating the door panel in a smooth motion, i.e. without too much jerking. This is because, by means of the transition surface, the abrupt transition between the first face and the mantle surface, and between the second face and the mantle surface if the second ball is present, is reduced.

In an embodiment of the door construction according to the present invention, the transition surface is a convex surface.

The inventors have found that a convex surface as a transition surface is an advantageous shape for the transition surface for allowing the first ball to roll in a gradual motion around the corner between the mantle surface and the first face, and if the second ball is present, for allowing the second ball to roll in a gradual motion around the corner between the mantle surface and the second face, thereby reducing wear to the cam member and the first ball, and if present, the second ball.

In an embodiment of the door construction according to the present invention, the cam member is symmetrical in the direction perpendicular to the first face and the second face, and the cam member is symmetrical in the direction extending along the support positions on the mantle surface of the cam member.

The symmetrical cam member offers the advantage that one single type of cam member can be used both for a pivot hinge with only a first ball and for a pivot hinge with a first ball and a second ball. It is therefore not required to provide different kinds of cam members.

In the case of a pivot hinge with only a first ball, this offers the advantage that both the first and the second face of the cam member are usable. In the event of wear to the first face of the cam member, the second face of the cam member can then be used. To this end, the cam member needs only to be rotated 180° in the rotation column of the at least one pivot hinge.

The symmetrical cam member is also advantageous if the at least one pivot hinge is arranged in the guide profile so that the at least one pivot hinge is located in the center of the door panel. In this case, the symmetry of the cam member allows the door panel to be rotated 360° or more. Herein, the first ball will be located in the first recess in the first face of the cam member when the door panel is in the closed position. When rotating the door panel to the first open position, the first ball subsequently positions itself in the first notch in the mantle surface of the cam member. When rotating the door panel even further, the first ball will position itself in the second recess in the second face of the cam member, wherein the door panel is in a second closed position, said second closed position being rotated 180° in relation to the initial closed position. The door panel can subsequently be rotated even further to the second open position, and then from there to the closed position as it was initially. It should be evident that the symmetry of the cam member also allows doing this in the opposite direction of rotation. Furthermore, it should also be evident that this also applies, mutatis mutandis, to the second ball, if the second ball is present.

In an embodiment of the door construction according to the present invention, the pivot hinge comprises a first adjustment means for adjusting the spring pressure of the first spring, and the pivot hinge, if the second spring is present, comprises a second adjustment means for adjusting the spring pressure of the second spring.

The adjustment means offer the advantage that the spring pressure from the first spring, and of the second spring, if present, can be adjusted to, among other things, the weight of the door panel or to the specific requirements of the user of the door construction. For instance, a larger spring pressure will be required for a heavy door panel than for a light door panel, to rotate the door panel to the closed position at approximately the same speed. Some users will prefer the door panel to close quickly, while other users will prefer the door panel to swing shut in a gentle manner.

After frequently opening and closing the door panel, it is possible for the spring pressure of the first spring, and of the second spring, if present, to change. In that event, it is also advantageous that the adjustment means are used to adjust the spring pressure again correctly. The adjustment means are therefore also advantageous for maintenance of the door construction according to an embodiment of the present invention.

In an embodiment of the door construction according to the present invention, the adjustment means comprises a screw, which is screwably arranged in an opening through the housing, and which is arranged to press against the end of the spring located opposite the end of the spring pressing against the ball, so that the spring pressure is adjustable by screwing the screw through the opening in the housing.

The inventors have found that the screw or bolt being screwably arranged in an opening through the housing provides an adjustment means for the spring pressure of the spring that is easily operable. Furthermore, the screw being screwable also offers the advantage that the distance over which the screw can be moved through the opening can be accurately adjusted, with the result that the spring pressure of the spring is also accurately adjustable. The accuracy with which the screw can be moved through the opening is determined by the pitch of the thread of the screw. The smaller the pitch, the smaller the distance over which the screw is movable through the distance with one turn of the screw about the longitudinal axis of the screw.

In an embodiment of the door construction according to the present invention, the head of the screw has a shape which is laterally engageable, so that the head of the screw is rotatable from a lateral position for screwing the screw through the opening in the housing.

The head of the screw being laterally engageable offers the advantage that the screw does not need to be screwed through the opening in the housing by means of a screwdriver. This is because the screwdriver needs to engage the head face of the head of the screw, and be oriented along the lengthwise direction of the screw while rotating the screw through the opening in the housing of the at least one pivot hinge. This is not always easy to carry out when the at least one pivot hinge is arranged in the guide profile. This is the case, for instance, when the at least one pivot hinge is for instance arranged at a certain distance from the side of the door panel, so that the screw is not accessible due to an insufficient length of the screwdriver. As a result of the head of the screw having a shape which is laterally engageable, the screw can be engaged from a position located at the front or the back or the side of the door panel, using a shorter screwing means for screwing the screw through the opening in the housing.

The term "laterally" should here be understood primarily to mean from a direction substantially perpendicular to the lengthwise direction of the screw, since from this direction the head of the screw is rotatable most easily when the at least one pivot hinge is arranged in the guide profile. It is, however, possible to deviate from this by engaging at an angle to the direction substantially perpendicular to the lengthwise direction of the screw.

Preferably, the screw is rotatable from a lateral position by means of a translational movement of a screwing means engaging the head of the screw.

In an embodiment of the door construction according to the present invention, the head of the screw is laterally engageable by means of grooves in the side of the head of the screw, said grooves being oriented along the lengthwise direction of the screw.

The inventors have found that the grooves in the circumferential surface of the head of the screw are easily arrangeable on the head of the screw. The grooves in the head of the screw are also advantageous for engaging therein laterally in relation to the screw. This can for instance be carried out by means of an L-shaped screwing means, of which the short leg can engage in one of the grooves, after which, by means of a pulling motion or a pushing motion on the long leg of the screwing means, the head of the screw, and with it also the screw, can be rotated through the opening in the housing.

In an embodiment of the door construction according to the present invention, the opening in the housing for the screw of the adjustment means is provided through a releasable cap of the housing.

Thus, herein, the releasable cap is preferably located in the proximity of the ends, considered from the lengthwise direction, of the housing. The releasable cap offers the advantage that the housing can readily be opened, for instance, for maintenance to the parts of the at least one pivot hinge which are located inside the housing, such as the first spring, the first ball, the second spring if present, and the second ball if present.

In an embodiment of the door construction according to the present invention, the housing is provided with at least one closable opening for introducing a lubricant into the housing.

The at least one closable opening for introducing a lubricant into the housing is advantageous for the prevention of wear to the parts of the at least one pivot hinge that are located inside the housing, such as for instance the cam member, the inside of the housing, the first ball, the first spring, the second ball if present, and the second spring if present. The lubricant ensures that the different parts of the at least one pivot hinge slide or roll better over each other, and thus limits the wearing of said parts. The at least one closable opening offers the advantage that the lubricant in the housing can readily be replenished during maintenance of the at least one pivot hinge, so that the proper operation of the at least one pivot hinge remains ensured. The at least one closable opening can for instance be a non-return valve.

If the at least one pivot hinge comprises a second spring and a second ball, at least one first closable opening is preferably provided in a first part of the housing, in which, among others, the first spring and the first ball are arranged, and at least one second closable opening in a second part of the housing, in which, among others, the second spring and the second ball are arranged. This allows both parts of the housing, located on opposite sides of the cam member, to be properly and easily filled with a lubricant.

In an embodiment of the door construction according to the present invention, the at least one pivot hinge comprises blocking means, arranged for preventing the rotation of the door panel beyond the open positions and in a direction away from the closed position.

The blocking means offer the advantage that the door panel cannot be opened too far, and for instance hit a wall or objects located behind the door panel, when the door panel is in one of the open positions. The blocking means thus protect the door panel from damage, and ensure the safety in the proximity of the door panel. Furthermore, the blocking means also offer the aesthetic advantage that the use of ugly door stops, which are typically placed on the floor or on a wall, can be avoided.

In an embodiment of the door construction according to the present invention, the guide profile is a part of a frame at the circumference of the door panel.

Integrating the guide profile at the bottom side and/or the top side of the door panel in a frame around the door panel offers the advantage that the forces exerted by the at least one pivot hinge on the guide profile are distributed over the entire frame. This enables the guide profile to better resist these forces. The load on the guide profile from the at least one pivot hinge is thus beneficially reduced.

In an embodiment of the door construction according to the present invention, the first spring and, if present, the second spring is a gas spring.

The gas spring offers the advantage that it can supply a substantially constant force over its entire range of operation. As a result of the use of the gas spring, the first ball, the second ball if present, and the cam member are subjected to a substantially constant, and thus highly controllable load during opening and closing of the door panel that is rotatably suspended in a door opening by means of the at least one pivot hinge, which is advantageous for limiting wear to these parts of the pivot hinge.

In an embodiment of the door construction according to the present invention, the gas spring is a deflatable gas spring, arranged for releasing gas from the gas spring to lower the spring force of the gas spring.

The use of a deflatable gas spring is advantageous while mounting the door construction according to an embodiment of the present invention. The spring force required from the first spring and, if present, the second spring depends on the weight of the door panel being suspended in the door opening by the at least one pivot hinge, and on the position where the at least one pivot hinge is located along the bottom side or the top side of the door panel. Using the deflatable gas spring, a first spring and, if needed, a second spring can be provided that are able to supply a certain spring force, and are later, when installing the door construction, are easily adjustable to the required spring force by releasing gas from the gas spring.

In an embodiment of the door construction according to the present invention, the deflatable gas spring is arranged for releasing a predetermined amount of gas from the gas spring, for lowering the spring force of the gas spring step by step.

The use of a deflatable gas spring arranged in this way offers the advantage that the spring force of the gas spring can be adjusted in a precise and controlled manner, so that an optimal operation of the pivot hinge can be achieved while installing the door construction according to an embodiment of the present invention. Using such a deflatable gas spring also makes it possible to easily prevent too much gas from being released from the gas spring, requiring the gas in the gas spring to be replenished to achieve the required spring force of the gas spring, which is more cumbersome than releasing the gas from the gas spring.

In an embodiment of the door construction according to the present invention, the gas spring is provided with damping, preferably hydraulic damping.

Using a gas spring with damping is advantageous for arranging the door construction according to an embodiment of the present invention so that when moving the door panel from one of the open positions to the closed position, the door panel is slowed down when it approaches the closed position. This is advantageous for obtaining a quick and controllable closing of the door panel, without oscillations of the door panel around the closed position.

Furthermore, the present invention provides a self-closing pivot hinge of the door construction according to an embodiment of the present invention.

Here, it should be noted that this self-closing pivot hinge can also be used in combination with other door panels, such as door panels not provided with a guide profile like the one in the door construction according to an embodiment of the present invention, wherein other attachment means are then provided for attaching the pivot hinges to the door panel. The self-closing pivot hinge can then for instance be arranged and secured in a recess in the door panel provided to that purpose. Herein, it is not necessary for the housing of the self-closing pivot hinge to be arranged to be slideable through a guide profile.

BRIEF DESCRIPTION OF THE DRAWINGS

The invention will hereafter be further elucidated by means of the following description and the appended figures.

MODES FOR CARRYING OUT THE INVENTION

Figure 1:
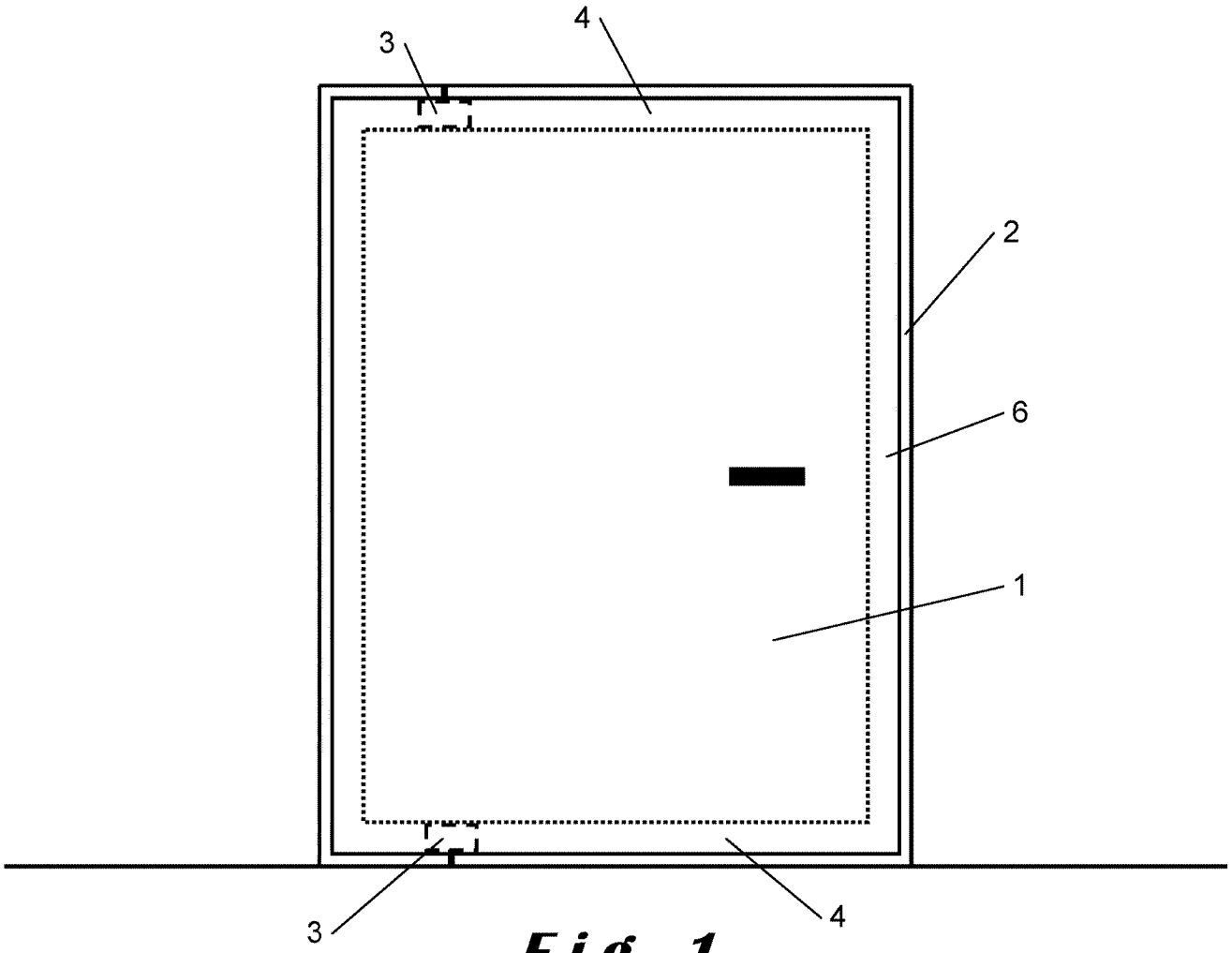
FIG. 1 shows, in a frontal view, a simplified representation of a door construction according to an embodiment of the present invention.

The present invention will hereafter be described with respect to particular embodiments and with reference to certain drawings, but the invention is not limited thereto and is only defined by the claims. The drawings shown here are only schematic depictions and are non-limiting. In the drawings, the size of some of the elements may be exaggerated, which means that the elements in question are not drawn to scale, this being merely for illustrative purposes. The dimensions and the relative dimensions do not necessarily correspond to actual reductions to practice of the invention.

Furthermore, terms like "first", "second", "third" and the like, are used in the description and in the claims for distinguishing between similar elements and not necessarily for describing a sequential or chronological order. The terms in question are interchangeable under appropriate circumstances, and the embodiments of the invention can operate in other sequences than described or illustrated herein.

Moreover, terms like "top", "bottom", "over", "under" and the like are used in the description and the claims for descriptive purposes, and not necessarily for describing relative positions. The terms so used are mutually interchangeable under appropriate circumstances, and the embodiments of the invention described herein can operate in other orientations than described or illustrated herein.

The term "comprising" and related terms, as used in the claims, should not be interpreted as being restricted to the means listed thereafter; it does not exclude other elements or steps. The term should be interpreted as specifying the presence of the stated features, integers, steps or components as referred to, without however precluding the presence or addition of one or more additional features, integers, steps or components, or groups thereof. Thus, the scope of the expression "a device comprising means A and B" is not limited to devices consisting merely of components A and B. What is meant, by contrast, is that with respect to the present invention, the only relevant components of the device are A and B.

It should be noted that the present invention is not limited to a door construction, and that other rotatable constructions, such as for example a window and a gate, can be implemented in a similar way as well. It should also be noted that the self-closing pivot hinge of the door construction according to the present invention is also highly suited to be used in those other rotatable constructions, either arranged slidingly in a guide profile of the rotatable construction, or arranged in the rotatable construction in any other way.

FIG. 1 shows a frontal view of a simplified representation of a door construction according to an embodiment of the present invention. The door construction shown comprises a door panel 1, which is rotatably suspended in a door opening 2 by means of a first pivot hinge 3 and a second pivot hinge 3. The first pivot hinge 3 is arranged in a first guide profile 4 extending along substantially the entire top side of the door panel 1, the second pivot hinge 3 is arranged in a second guide profile extending along substantially the entire bottom side of the door panel 1. Both guide profiles 4 are part of a frame 6, provided at the edges of the door panel 1.

The pivot hinges 3 are slideable along the lengthwise direction of the guide profiles 4, and the pivot hinges 3 are releasably attached to guide profiles 4 by means of attachment means (not shown in FIG. 1). These attachment means can for instance be bolts or screws by means of which the pivot hinges 3 can be screwed to the guide profiles 4, or, for instance, a tensioning system for clamping the pivot hinges 3 into the guide profiles 4, or other releasable attachment means known to the person skilled in the art. As a result of the pivot hinges 3 being slideable in the guide profiles 4, there is a greater freedom of choice regarding the position where the pivot hinges 3 are attached to the guide profiles 4. This position defines the position of the rotational axis or pivot axis around which the door panel 1 rotates, for which there is, consequently, an extensive freedom of choice as well. Herein, the pivot hinges 3 should logically be aligned straight above each other. For a regular door panel 1 of standard dimensions, the rotational axis is typically chosen so that it is located as close as possible against one of the sides of the door opening 2. As a result of this, the entire width of the door opening 2 can be used for passing through. For a wide door panel 1, it is advantageous to choose the rotational axis at a certain distance from the side of the door opening 2, for instance at ⅔ of the width of the door panel 1. As a result of this, a smaller force is required to be exerted on the door panel 1 for opening and closing the door panel 1. Alternatively, the rotational axis can for instance also be chosen to be in the center of the door panel 1, so that forces exerted on opposite sides of the pivot axis cancel each other out. As a further alternative, the rotational axis may be chosen to be essentially at any position between both sides of the door panel 1.

In the embodiment of the door construction according to the present invention shown here, the door panel 1 is rotatably suspended in the door opening 2 by means of two pivot hinges 3, which are arranged in guide profiles 4 at the bottom side of the door panel 1 and at the top side of the door panel 1. In other embodiments, however, the door panel 1 may also be rotatably suspended in the door opening 2 by means of a single pivot hinge 3. This pivot hinge 3 is then integrated into the door panel 1 at the bottom side of the door panel 1 or at the top side of the door panel 1, and at the opposite side, though not necessary, a rotation axis element can be arranged. Said rotation axis element may for instance be a connection between the door panel and the wall of the door opening 2, provided with a bearing or a sliding bushing.

Figure 2:
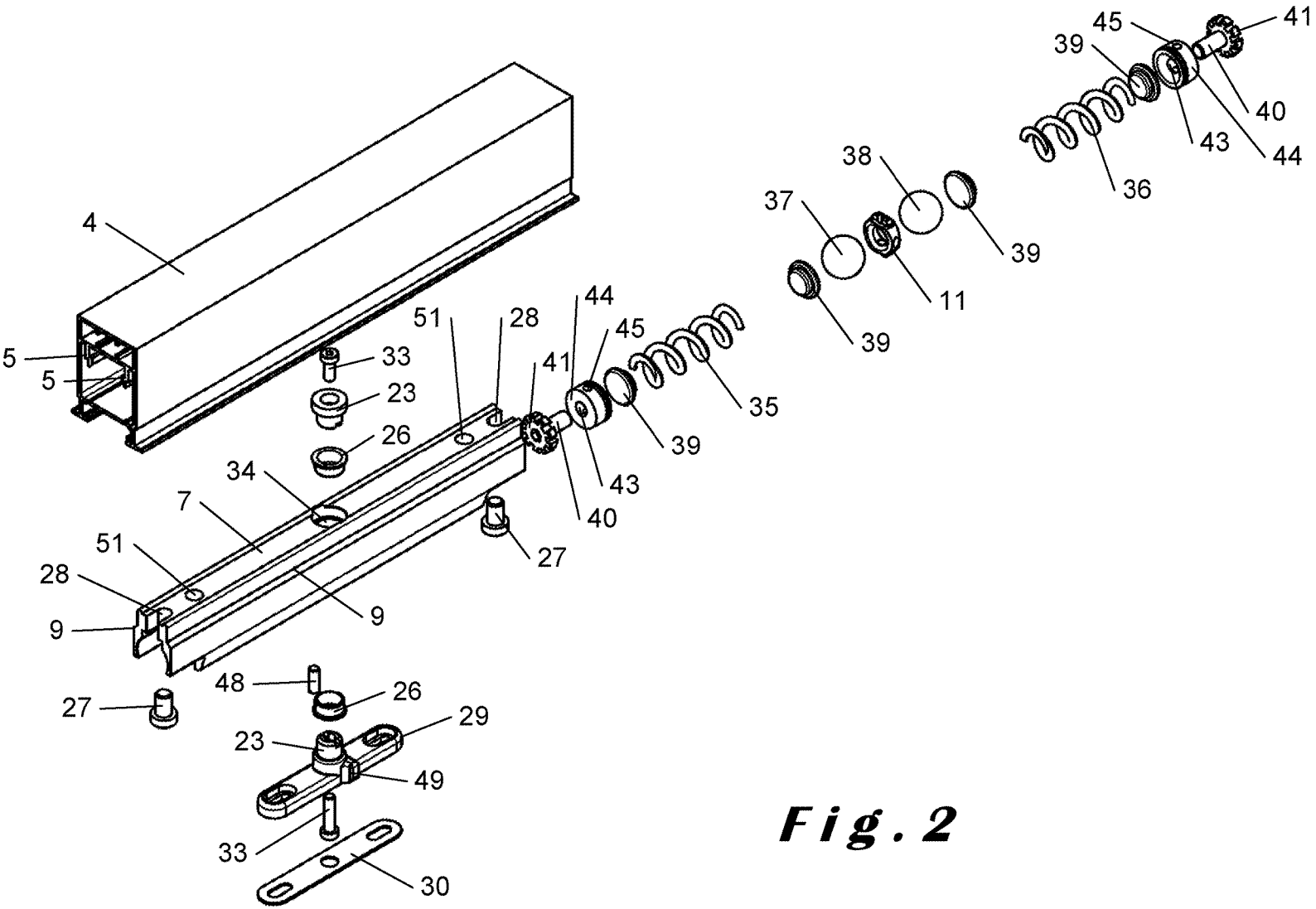
FIG. 2 shows an exploded view of a pivot hinge of a door construction according to an embodiment of the present invention.
Figure 3:
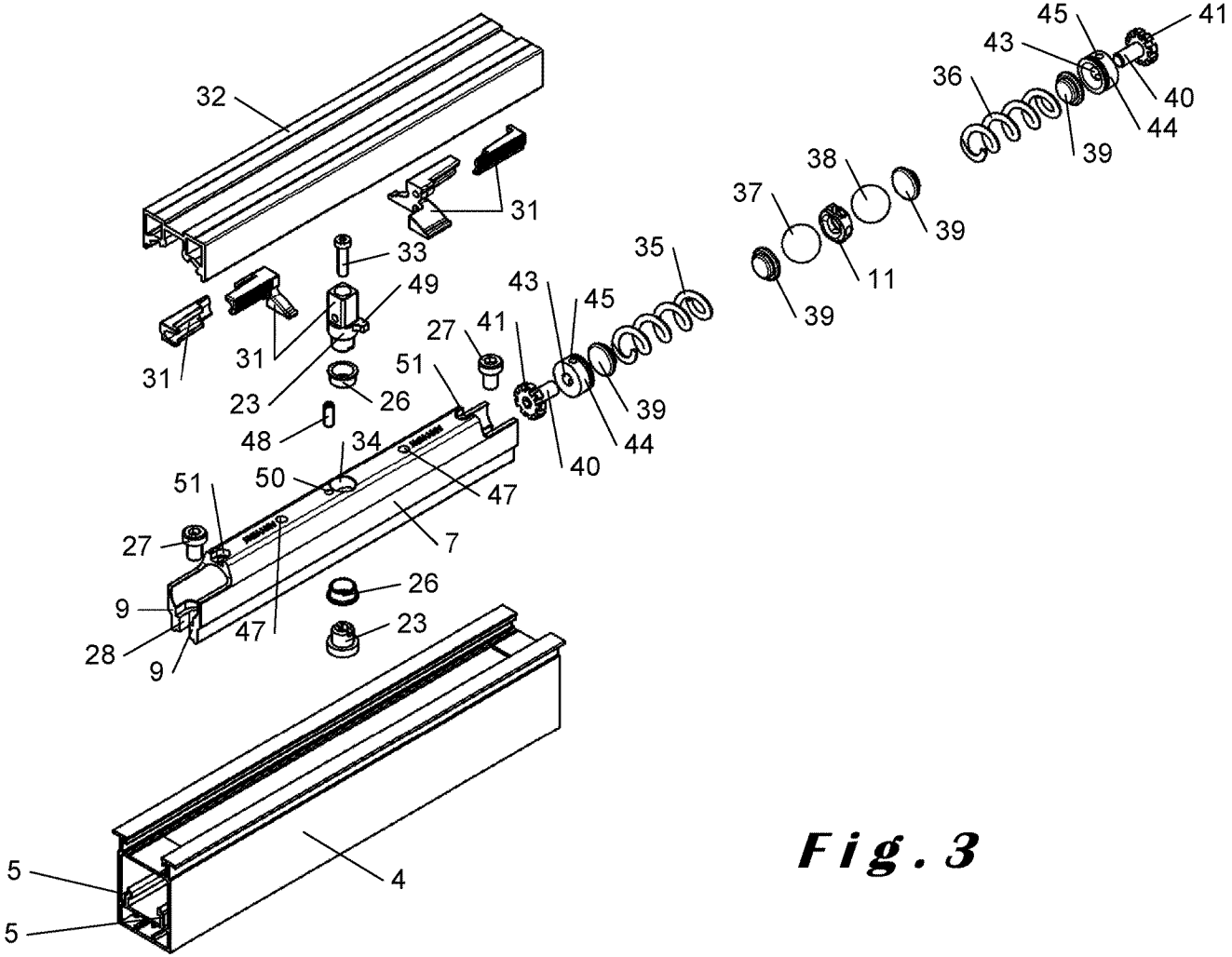
FIG. 3 shows an exploded view of a pivot hinge of a door construction according to an embodiment of the present invention.
Figure 4:
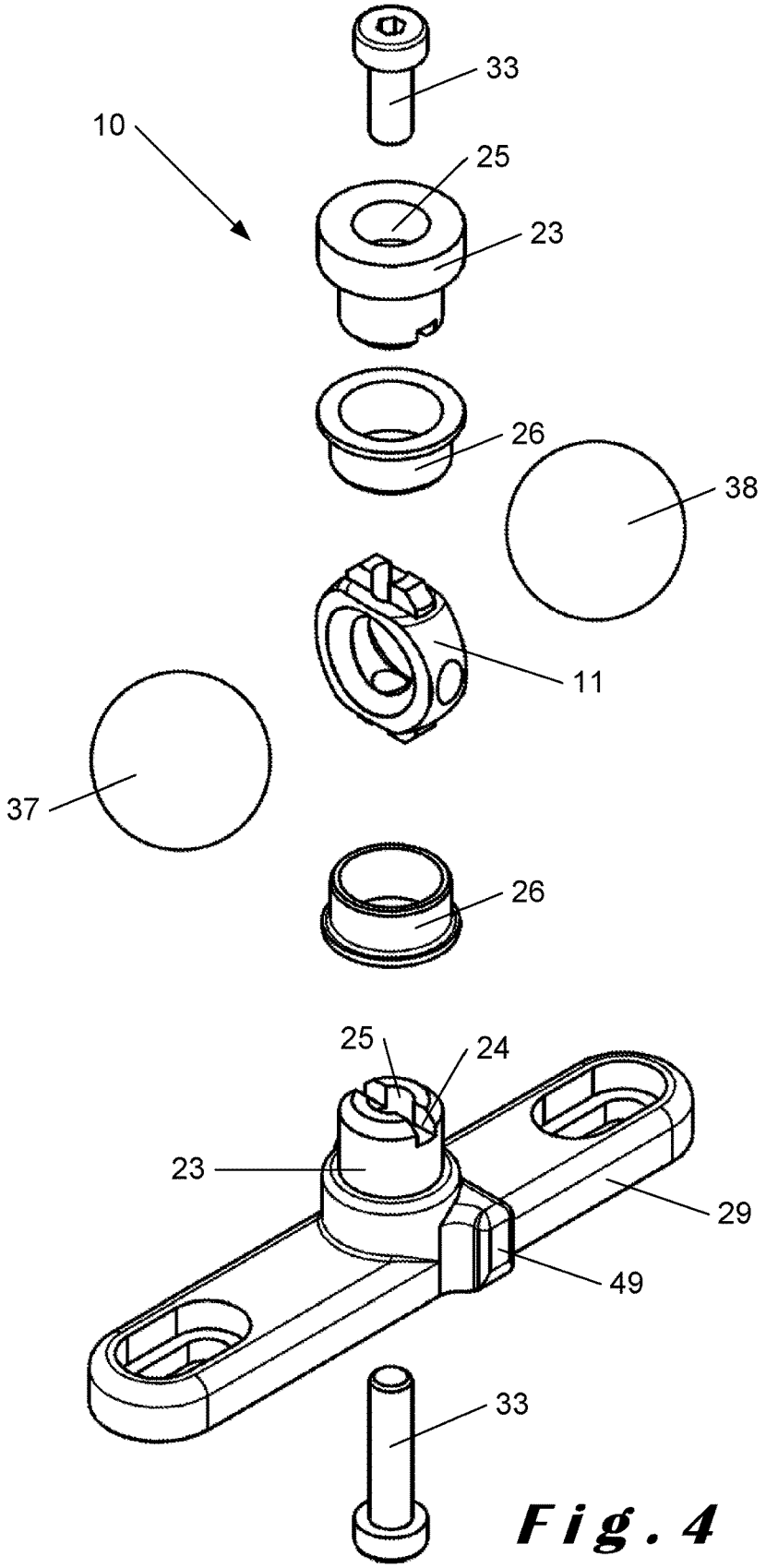
FIG. 4 shows an exploded view of the rotation column of the pivot hinge shown in FIG. 2.
Figure 5:
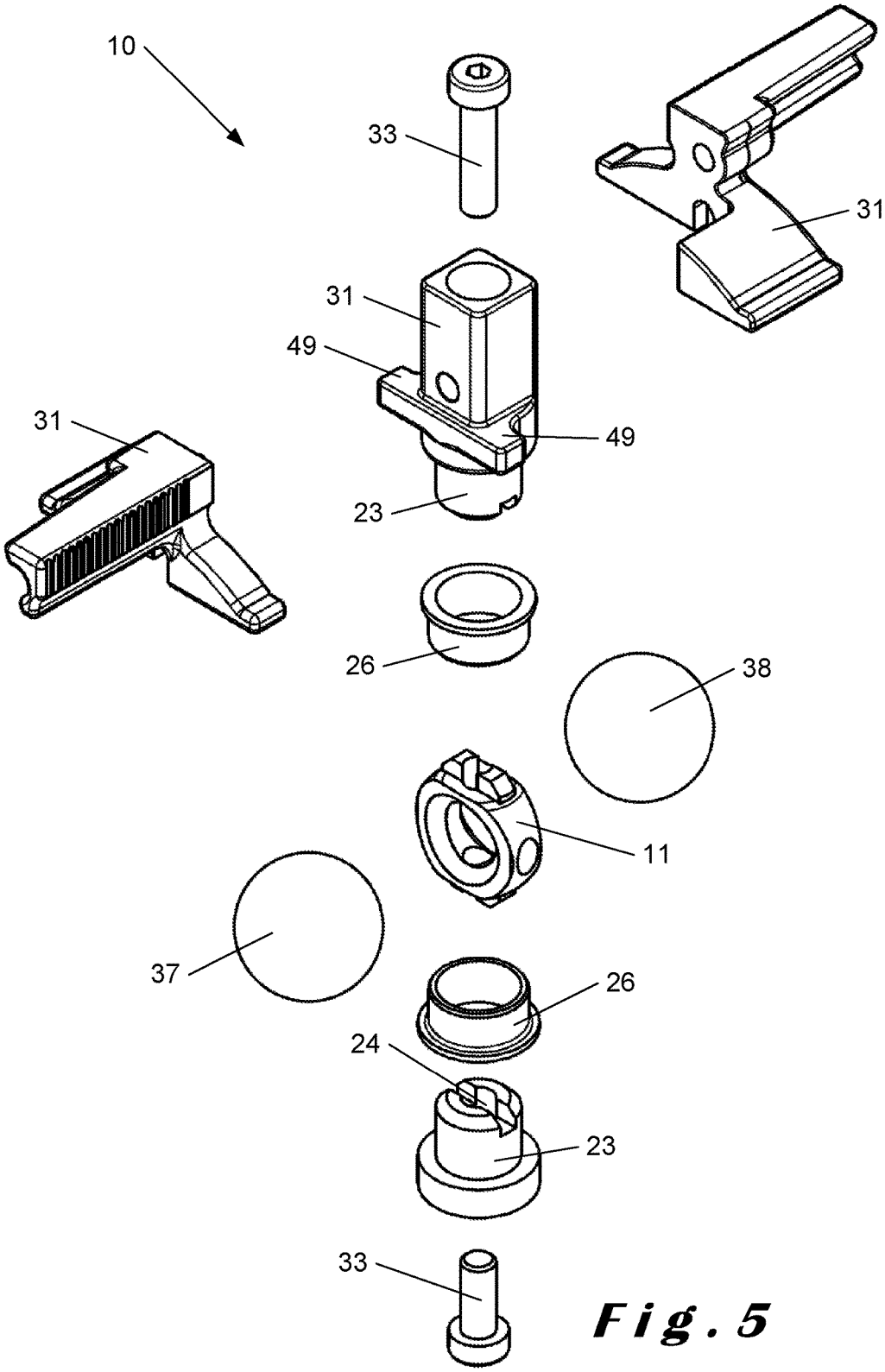
FIG. 5 shows an exploded view of the rotation column of the pivot hinge shown in FIG. 3.
Figure 6:
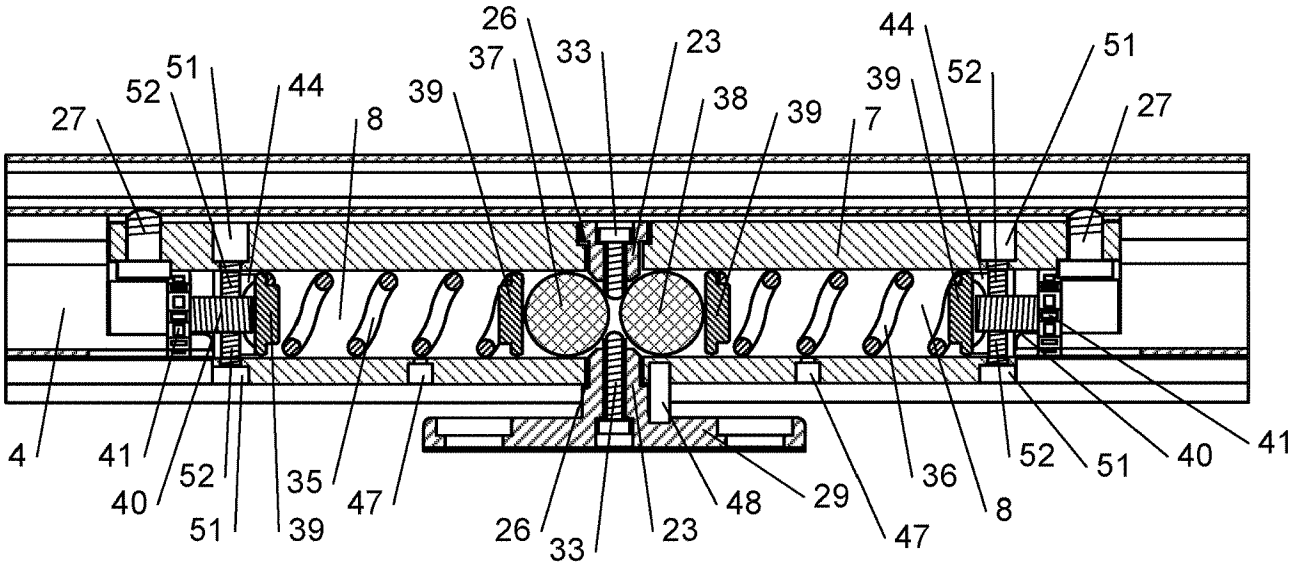
FIG. 6 shows a cross-section through the pivot hinge shown in FIG. 2, arranged in a guide profile.

FIGS. 2 and 3 show an exploded view of a pivot hinge 3 according to different embodiments of the door construction according to the present invention. For the greater part, both pivot hinges 3 shown are shaped and constituted in the same way. The pivot hinges 3 shown differ in the way in which they are arranged to be mounted to a wall of a door opening 2. The pivot hinge 3 shown in FIG. 2 is thereto provided with a wall mounting part 29, which can be mounted directly to the wall of the door opening 2 by means of screws. The wall mounting part 29 in question is provided with an attenuation means 30 to counter the transfer of vibrations from the door panel 1 and the pivot hinge 3 to the wall of the door opening 2, and vice versa. In the pivot hinge 3 shown in FIG. 3, a wall profile mounting part 31 of modular construction is used to this end, which can be connected with a wall profile 32 arranged on the wall of the door opening 2, for instance as a part of a door casing. FIGS. 4 and 5 show the central part of the pivot hinges 3 shown in FIGS. 2 and 3, particularly the rotation column 10, in more detail. FIG. 6 shows a cross-section through the pivot hinge 3 shown in FIG. 2, mounted in a guide profile 4. The cross-section extends centrally through the pivot hinge 3 along the lengthwise direction of the pivot hinge 3, as additionally indicated with line VI-VI in FIG. 7, where a side view is shown of the pivot hinge 3 shown in FIG. 2 mounted in a guide profile 4. The construction of the pivot hinge 3 according to an embodiment of the door construction according to the present invention is elucidated below, with reference to these figures.

The pivot hinge 3 comprises an elongated housing 7 with a cavity 8 arranged therein, in which a number of the parts of the pivot hinge 3 are arranged. In the center, considered along the lengthwise direction of the housing 7, a rotation column 10 is arranged through the housing 7, in such a way that the housing 7 is rotatable around the rotation column 10.

The housing 7 of the pivot hinge 3 is provided with two sliding surfaces 9, arranged in the lengthwise direction of the housing 7 and on opposite sides of the housing 7. The sliding surfaces 9 of the housing 7 are arranged to slide over two sliding surfaces 5 of the guide profile 4 in which the pivot hinge 3 is arranged. The sliding surfaces 5 of the guide profile 4 have a shape that is complementary to the shape of the sliding surfaces 9 of the housing 7. The sliding surfaces 5 of the guide profile 4 are arranged over substantially the entire length of the guide profile 4, so that the pivot hinge 3 is slideable through the guide profile 4 over substantially the entire length of the guide profile 4. It is evident that the housing 7 and the guide profile 4 may also be implemented in different ways, though preferably complementary to each other and/or fitting inside each other.

The rotation column 10, shown in detail in FIGS. 4 and 5, is constructed from a cam member 11 positioned inside the cavity 8 of the housing 7, and retained by two cam member retainers 23 placed in two openings 34 through the housing 7 located opposite each other, known as rotation column openings 34. A first of these rotation column openings 34 is located at a side of the housing 7 arranged to face the door panel 1 when the pivot hinge 3 is arranged in the guide profile 4, and a second of these rotation column openings 34 is located at a side of the housing 7 arranged to face the wall of the door opening 2 when the pivot hinge 3 is arranged in the guide profile 4. The cam member retainer 23 positioned in this second rotation column opening 34 is part of a means 29, 31 for releasably attaching the pivot hinge 3 to the wall of the door opening 2, either directly to the wall by means of the wall mounting part 29 as shown, among others, in FIG. 2, or via of a wall profile 32 on the wall, by means of the wall profile mounting part 31, as shown, among others, in FIG. 3.

The cam member retainers 23 retain the cam member 11 by means of a groove 24 arranged on each of the cam member retainers 23, and by means of protrusions 20 arranged on the cam member 11 and placed in the groove 24 of the cam member retainers 23. The protrusions 20 on the cam member and the groove 24 in each of the cam member retainers 23 are shaped so that the cam member 11 and the cam member retainers 23 cannot rotate in relation to each other.

Furthermore, the cam member retainers 23 are also connected to the cam member 11 by means of screws 33 screwed into openings 21, 25 provided thereto in the cam member 11 and in the cam member retainers 23. In the embodiment shown, two screws 33 are used for separately connecting each of the cam member retainers 23 to the cam member 11, but optionally a single screw 33 can be used that extends through the cam member 11 and connects to both cam member retainers 23.

The cam member retainers 23 and the rotation column openings 34 are also shaped in such a way that the cam member retainers 23 can only be inserted into the rotation column openings 34 up to a certain depth. That way, when the cam member 11 is connected on opposite sides to the cam member retainers 23 by means of the screws 33 provided thereto, the housing 7 is clamped between the cam member retainers 23 in such a way that the rotation column 10 is substantially only rotatable in relation to the housing 7, and so can no longer shift in relation to the housing 7.

Furthermore, the rotation column 10 is provided with two sliding bushings 26, also placed in the rotation column openings 34 in which the cam member retainers 23 are placed as well. These sliding bushings 26 are arranged between the cam member retainers 23 and the housing 7, and there reduce the friction between the cam member retainers 23 and the housing 7 when rotating the cam member retainers 23 in the rotation column openings 34. As a result of this, the rotation of the housing 7 around the rotation column 10 occurs more smoothly.

Figure 17:
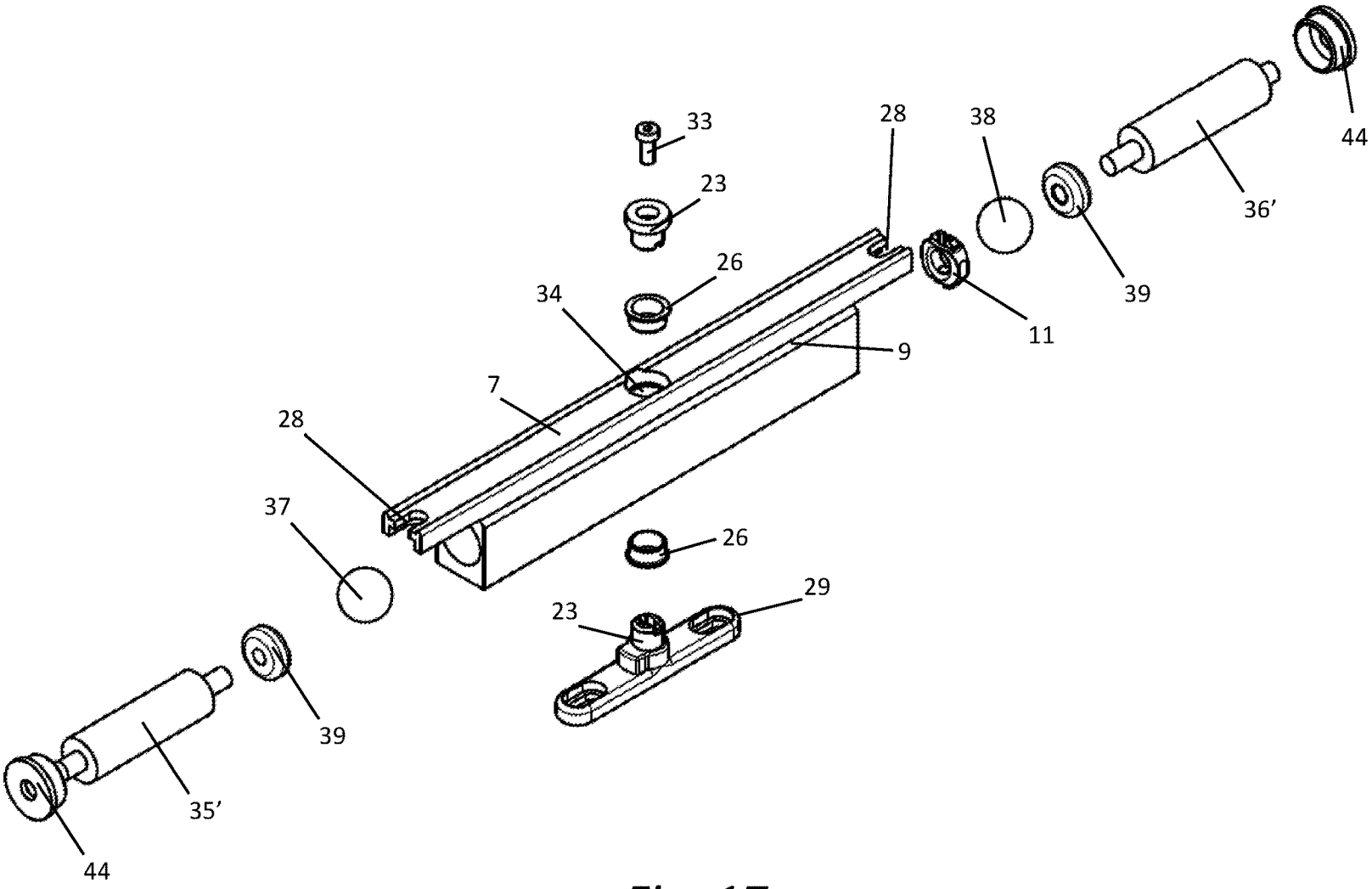
FIG. 17 shows an exploded view of a pivot hinge with gas springs of a door construction according to an embodiment of the present invention.

On opposite sides of the rotation column 10 a first spherical ball 37 and a second spherical ball 38 are arranged in the housing, and said balls 37, 38 are pressed against the cam member 11 of the rotation column 10 by a first spring 35 and a second spring 36, respectively. The first ball 37 and the second ball 38 are arranged to roll over the surface of the cam member 11 when rotating the housing 7 around the rotation column 10 while opening and closing the door panel 1. The cam member 11 is shaped to provide support positions 15, 16, 17 in which the first ball 37 and the second ball 38 rest when the door panel 1 is in the closed position and when the door panel 1 is in one of the open positions. In the embodiments shown, the springs 35, 36 are implemented as cylindrical springs, but the springs 35, 36 can also be equivalently implemented as any other resilient element, such as for example a pneumatic spring 35', 36' or gas spring 35', 36', as shown in FIG. 17.

Furthermore, the cam member 11 is also shaped in such a way that the first spring 35 and the second spring 36 are in a compressed state when the first ball 37 and the second ball 38 are in the support positions 17 on the cam member 11 corresponding to the open positions of the door panel 1, being compressed in comparison with the state of the first spring 35 and the second spring 36 when the first ball 37 and the second ball 38 are in the support positions 15, 16 on the cam member 11 corresponding to the closed position of the door panel 1. The compressed first spring 35 and the compressed second spring 36 ensure that the first ball 37 and the second ball 38, respectively, are urged towards the support positions 15, 16 on the cam member 11 corresponding to the closed position of the door panel 1. As such, the first spring 35 and the second spring 36 bestow a self-closing function to the pivot hinge 3 according to the embodiments shown.

Figure 11:
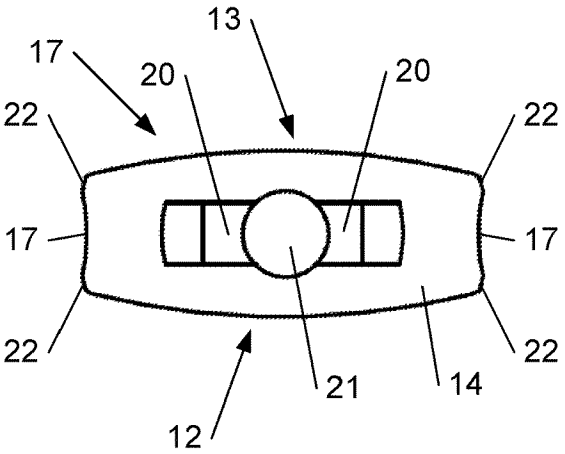
FIG. 11 shows a top view of the cam member shown in FIG. 9.
Figure 10:
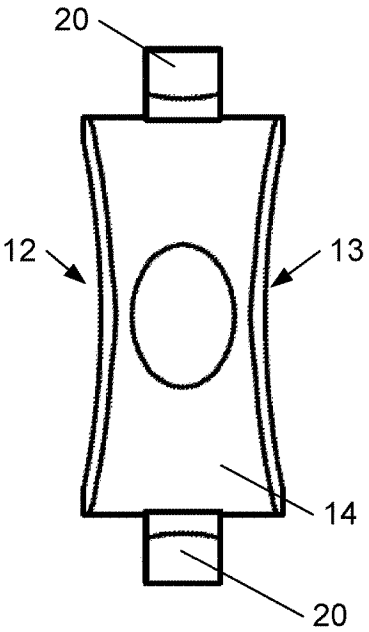
FIG. 10 shows a side view of the cam member shown in FIG. 9.
Figure 9:
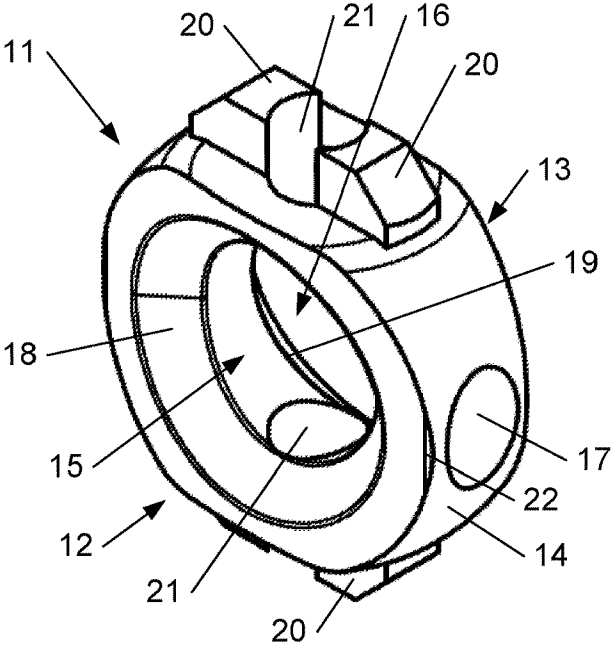
FIG. 9 shows a perspective view of the cam member of the pivot hinge shown in FIG. 2 and FIG. 3.

The cam member 11 is shown in more detail in FIGS. 9-11. The cam member 11 according to the embodiment shown is a disc-shaped object comprising a first face 12 and a second face 13, and a mantle surface 14 connecting the first face 12 and the second face 13. The housing 7 of the pivot hinge 3 and the door panel 1 are arranged to rotate about a rotational axis extending through the cam member 11, said rotational axis being positioned along the vertical direction, centrally through the cam member 11 in the embodiment shown.

The cam member 11 provides support positions 15, 16 in which the first ball 37 and the second ball 38 rest when the door panel 1 is in the closed position. For the first ball 37, the support position 15 is provided in the form of a first recess 15 in the first face 12, and for the second ball 38, the support position 16 is provided in the form of a second recess 16 in the second face 13.

The first recess 15 and the second recess 16 provided at their circumference with a first support surface 18 for the first ball 37 and with a second support surface 19 for the second ball 38, respectively. The support surfaces 18, 19 ensure a proper support for the balls 37, 38 in the recesses 15, 16. These support surfaces 18, 19 are preferably provided with a shape complementary to the shape of the balls 37, 38, which ensures an even more stable positioning of the balls 37, 38 in the recesses 15, 16.

The first recess 15 and the second recess 16 in the cam member 11 shown are arranged so that there is a passage through the cam member 11, extending from the first face 12 of the cam member 11 to the second face 13 of the cam member 11. This allows both the first ball 37 and the second ball 38 to be lowered as deeply as possible into, preferably both until halfway through, the cam member 11 when the door panel 1 is in the closed position. This increases the spring path of the first spring 35 and of the second spring 36.

The cam member 11 also provides support positions 17 in which the first ball 37 and the second ball 38 rest when the door panel 1 is in the first open position and when the door panel 1 is in the second open position. These support positions 17 are provided on the cam member 11 in the form of two notches 17 on the mantle surface 14. Said two notches 17 are located at two opposite positions on the mantle surface 14 according to a horizontal direction centrally through the cam member 11 and the mantle surface 14, and these two notches 17 are consequently on opposing sides of the rotational axis through the cam member 11 mentioned above. Said notches 17 are used by both balls 37, 38. When the door panel 1 is in the first open position, the first ball 37 rests in one of the two notches 17 while the second ball 38 rests in the notch 17 located opposite the notch 17 in which the first ball 37 rests. When the door panel 1 is in the second open position, each ball 37, 38 rests in the notch 17 located opposite the notch 17 in which each respective ball 37, 38 rests when the door panel 1 is in the first open position.

At the transition between the mantle surface 14 and the first face 12, and at the transition between the mantle surface 14 and the second face 13, transition surfaces 22 are arranged on the mantle surface 14 in the proximity of the notches 17. The transition surfaces 22 are provided for facilitating the transition of the balls 37, 38 from the first face 12 or the second face 13 to the mantle surface 14, and the transition of the balls 37, 38 in the opposite direction. The transition surfaces 22 are preferably convex surfaces.

The cam member 11 is also provided with protrusions 20, which are, as mentioned above, arranged to be inserted into a groove 24 provided thereto on each of the cam member retainers 23 retaining the cam member 11 in the rotation column 10. These protrusions 20 are located at two opposite positions on the mantle surface 14 along the vertical direction centrally through the cam member 11, i.e., along the rotational axis through the cam member 11. Additionally, openings 21 through the cam member 11 are also provided at these positions. These openings 21 are arranged for providing a screw connection between the cam member 11 and the cam member retainers 23 by means of screws 33.

FIG. 10 shows how the first face 12 and the second face 13 are shaped as a concave surface along the vertical direction of said faces 12, 13, i.e., in the direction substantially parallel to the rotational axis through the cam member 11. FIG. 11 shows how the first face 12 and the second face 13 are shaped as a convex surface along the horizontal direction of said faces 12, 13.

The cam member 11 according to the embodiment shown is furthermore point-symmetrical in relation to a central point of the cam member 11. Rotating the cam member 11 over an angle of 180° in relation to this central point thus brings the cam member 11 back onto itself. As a result of this, the cam member 11 is rotatable so that the first recess 15 in the first face 12 and the second recess 16 in the second face 13 change places, without thereby influencing the construction and the operation of the pivot hinge. The same also applies to the notches 17 on the mantle surface 14, and also to the protrusions 20 on the mantle surface of the cam member 11.

When rotating the door panel 1 in the door opening 2, the pivot hinge 3 according to the embodiments shown functions as follows. If the door panel 1 is in the closed position, the first ball 37 rests in the first recess 15 in the first face 12 of the cam member 11, and the second ball 38 rests in the second recess 16 in the second face 13 of the cam member 11. This position is shown in FIG. 2, among others. From the closed position, the door panel 1 can be rotated to a first open position, in which the door panel 1 is rotated over an angle of approximately 90° in relation to the closed position. The door panel 1 can also be rotated to a second open position, in which the door panel 1 is rotated over an angle of 90° in the opposite direction.

Figure 8:
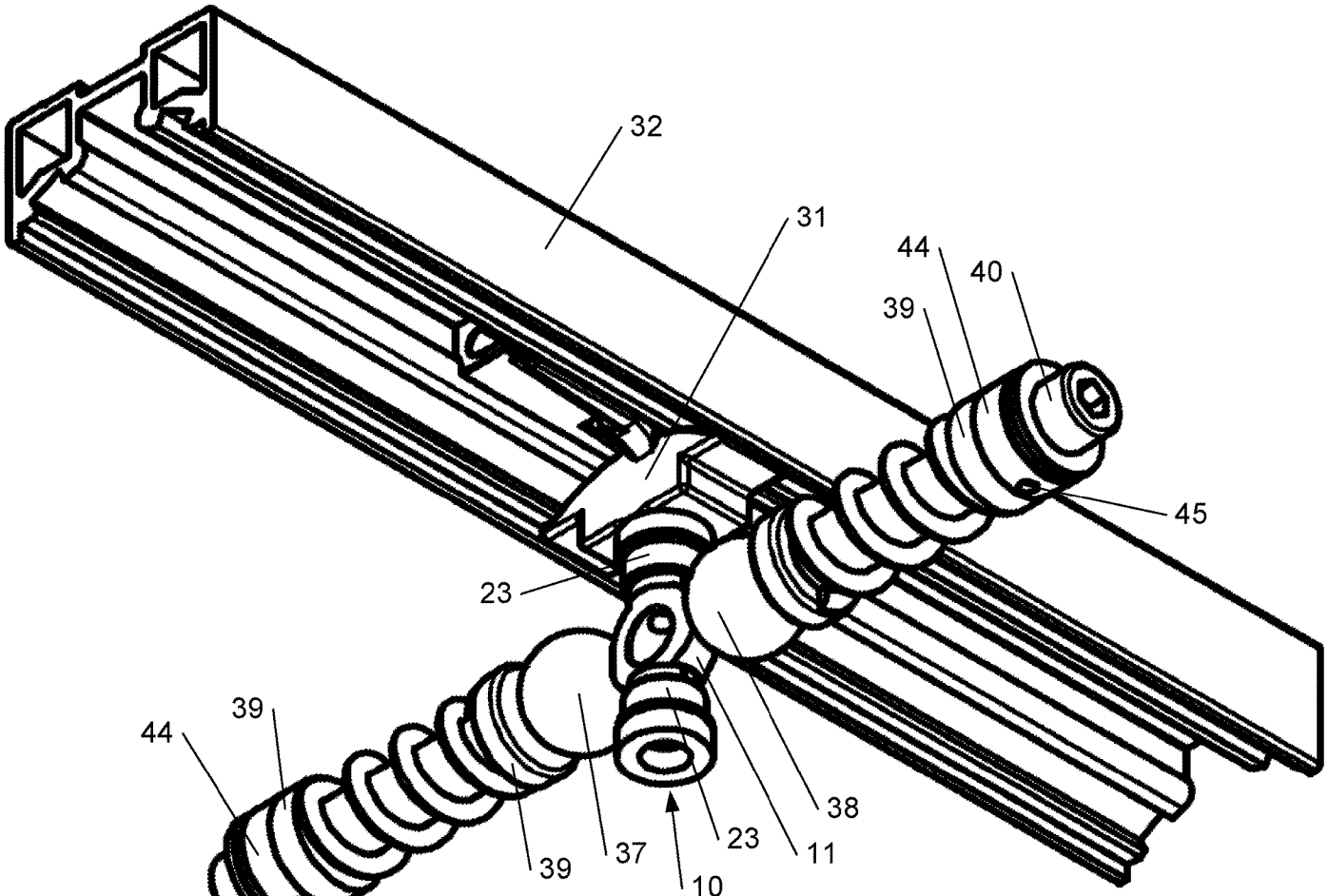
FIG. 8 shows a perspective view of a part of a pivot hinge of a door construction according to an embodiment of the present invention, wherein the pivot hinge is in the open position.

When rotating the door panel 1 from the closed position to one of the open positions, the housing 7 of the pivot hinge 3 rotates around the rotation column 10. The first ball 37 and the second ball 38 herein rotate together with the housing 7 around the rotation column 10, and the balls 37, 38 herein roll over the surface of the cam member 11, as the balls 37, 38 are pressed against the cam member 11 by the springs 35, 36. Thus, the first ball 37 rolls out of the first recess 15 and over the first face 12, then over one of the transition surfaces 22 between the first face 12 and the mantle surface 14, and finally over the mantle surface 14 up to and into one of the notches 17 on the mantle surface 14. Simultaneously, the second ball 38 rolls out of the second recess 16 and over the second face 13, then over a transition surface 22 and the mantle surface, up to and into the notch 17 on the mantle surface 14 located opposite the notch 17 in the mantle surface 14 to which the first ball 37 rolls. This position of the pivot hinge 3 is shown in FIG. 8, where the housing 7 is not shown to show the inner parts of the pivot hinge 3 more clearly.

From the open positions, the door panel 1 can then be rotated back to the closed position. To this end, it suffices to exert a force only on the door panel 1, causing the balls 37, 38 to roll out of the notches 17 on to the mantle surface 14 up to the transition surfaces 22. From this position, a moment is exerted by the springs 35, 36 on the cam member 11 via the balls 37, 38, causing the first ball 37 to roll over the first face 12 up to and into the first recess 15, and causing the second ball 38 to roll over the second face 13 up to and into the second recess 16. Thus, the springs 35, 36 provide the self-closing function of the pivot hinge 3.

Furthermore, the pivot hinge 3 according to the embodiment shown comprises a first adjustment means 40 for adjusting the spring pressure of the first spring 35, and a second adjustment means 40 for adjusting the spring pressure of the second spring 36. Both adjustment means are implemented as a screw 40, arranged screwable in an opening 43 through the housing 7. For each adjustment means, the screw 40 presses against the end of the spring 35, 36 located opposite the end of the spring 35, 36 that presses against the balls 37, 38. By screwing the screw 40 in a direction inwards in the housing, the spring pressure of the spring 35, 36 against which the screw 40 presses is increased, and by screwing the screw 40 in the opposite direction, the spring pressure is reduced. The use of a screw 40 allows the spring pressure of the springs 35, 36 to be finely adjusted.

Figure 7:
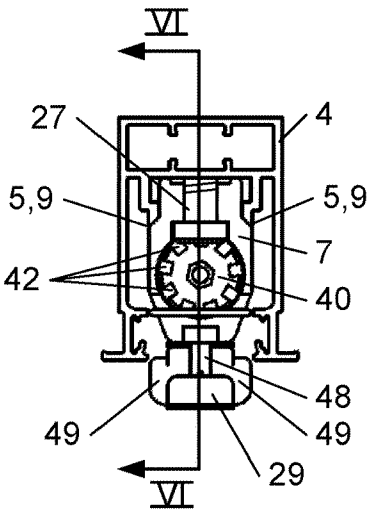
FIG. 7 shows a side view of the pivot hinge shown in FIG. 2, arranged in a guide profile.
Figure 13:
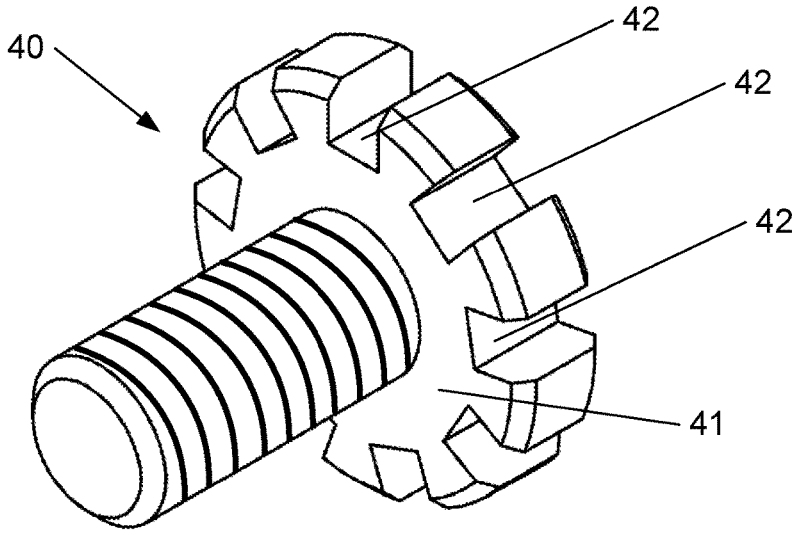
FIG. 13 shows a perspective view of the screw of the adjustment means of the pivot hinge shown in FIG. 2 and FIG. 3.

The screw 40 of the adjustment means is shown in more detail in FIG. 13. At the head side, the head 41 of the screw 40 is provided with a recess (not visible) for allowing a screwing means, such as for example a screwdriver or a socket head wrench, to engage therein. In the embodiment shown, such as can be seen in FIG. 7, a hexagonal recess is used, but it can be any shape known to the person skilled in the art, such as for example a slot or a cross. Furthermore, the head 41 of the screw 40 is arranged to be laterally engageable by means of grooves 42 in the side of the head 41 of the screw 40. These grooves 42 are arranged to allow an L-shaped screwing means (not shown) to engage therein and, by means of a pulling motion or a pushing motion, to screw the screw 40 through the opening 43 in the housing 7. The L-shaped screwing means in question may be shorter than a screwing means engaging the recess in the head side of the head 41 of the screw 40, such as a screwdriver. This is because the screw 40 is typically accessible over a shorter distance from a lateral position relative to the pivot hinge 3 arranged in a guide profile 4, than it is from one of the ends of the guide profile 4. The short distance between the screw 40 of the adjustment means and the side of the guide profile 4 can be seen in FIG. 7, among others.

Furthermore, the pivot hinge 3 also comprises pressing elements 39 arranged between the springs 35, 36 and the balls 37, 38, on the one hand, and between the springs 35, 36 and the adjustment means for adjusting the spring pressure on the other hand. The pressing elements 39 shown are in the form of a piston of which the narrow part is arranged in the spring 35, 36, and of which a wider part presses against the spring 35, 36. The pressing elements 39 are arranged for improving the contact between the springs 35, 36 and the balls 37, 38, and for improving the contact between the springs 35, 36 and the adjustment means 40 for adjusting the spring pressure.

In the embodiments shown, the openings 43 through the housing 7, in which the screws 40 of the adjustment means are positioned, are arranged through releasable caps 44 of the housing 7. The caps 44 provide an easy access to the internal parts of the pivot hinge 3, such as, among others, the springs 35, 36 and the balls 37, 38.

Figure 12:
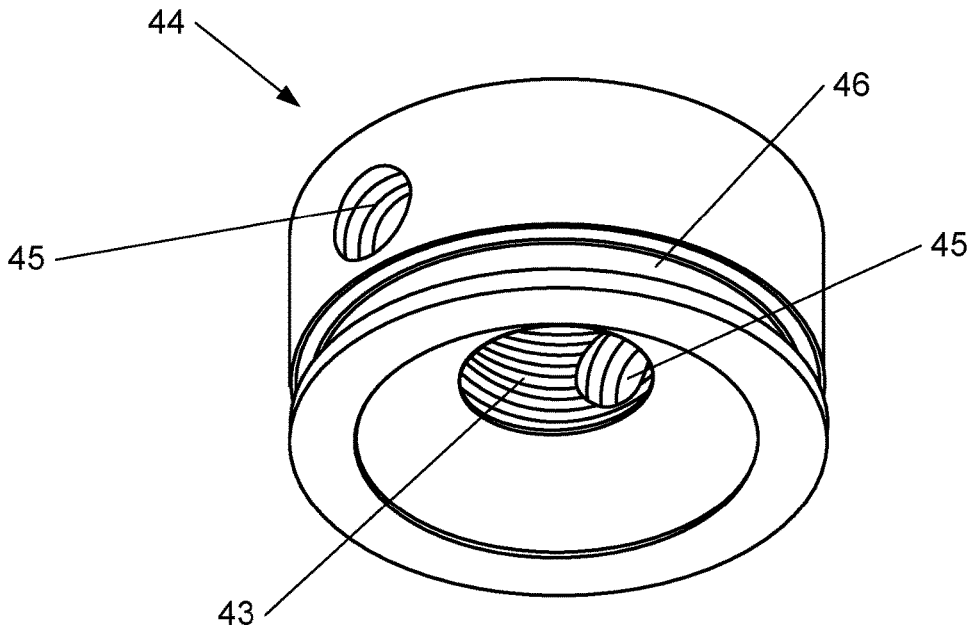
FIG. 12 shows a perspective view of the releasable cap of the pivot hinge shown in FIG. 2 and FIG. 3.

The cap 44 is shown in more detail in FIG. 12. Here, centrally in the cap 44, the opening 43 for the screw 40 of the adjustment means for the spring pressure is visible. Furthermore, the cap 44 is also provided with two openings 45, arranged for receiving screws 52 with which the cap 44 can be secured in the housing 7. To this end, the respective screws 52 are arranged through openings 51 provided thereto in the housing 7, and also through the openings 45 in the cap 44. Around its entire circumference, the cap 44 is also provided with a recess 46 for placing an O-ring (not shown) therein. The O-ring contributes to the hermetical sealing of the housing 7 so that, for instance, no lubricant can leak from the cavity 8 in the housing 7.

For releasably attaching the pivot hinges 3 shown to the guide profile 4 by means of attachment means 27, the pivot hinges 3 are provided with openings 28 through the wall of the housing 7. These openings 28 in the housing 7 are preferably arranged at the ends of the housing 7, so that a maximal amount of space remains in the housing 7 for the first spring 35 and the second spring 36. To this end, the openings 28 in the housing 7 of the pivot hinges shown are implemented as U-shaped openings 28 at the two ends of the housing 7. Attaching the pivot hinge 3 to the guide profile 4 is carried out by applying screws 27 of the attachment means through said openings 28, and subsequently by screwing these screws 27 in the openings (not shown) provided thereto in the guide profile 4. As such, the screws 27 of the attachment means clamp the pivot hinge 3 tightly against the guide profile 4. These openings in the guide profile 4 for attaching the pivot hinge 3 can be made in the guide profile 4 while arranging the pivot hinge 3 in the guide profile 4, for instance by means of a drilling machine.

In the embodiments shown, the pivot hinges 3 are also provided with two closable openings 47, implemented as non-return valves, for introducing a lubricant into the housing 7. A first of these closable openings 47 is located at the part of the housing 7 where the first spring 37 is located, and a second of these closable openings 47 is located at the part of the housing 7 where the second spring 38 is located. In this way, the parts of the housing 7 located at opposite sides of the rotation column 10 can be easily and properly filled with a lubricant.

Furthermore, the pivot hinges 3 shown are also provided with blocking means 48, 49 that prevent the door panel 1 from being able to rotate beyond the open positions in a direction away from the closed position. The blocking means 48, 49 comprise a blocking pin 48 and two blocking protrusions 49. The blocking pin 48 is arranged in an opening 50 provided thereto in the housing 7 at the side of the housing 7 arranged to face the wall of the door opening 2 when the pivot hinge 3 is arranged in the guide profile 4, and in the proximity of the rotation column 10. In the pivot hinge 3 shown in FIG. 2, the two blocking protrusions 49 are arranged on the wall mounting part 29, and in the pivot hinge shown in FIG. 3, the two blocking protrusions 49 are arranged on the wall profile mounting part 31. The blocking protrusions 49 are oriented along a direction substantially perpendicular to the door panel 1, when the door panel 1 is in the closed position. The height of the blocking pin 48 and the height of the blocking protrusions 49 are chosen so that the blocking pin 48 cannot pass beyond the blocking protrusions 49 when rotating the door panel 1 around the rotation column 10. When rotating the door panel 1 from the closed position to the open positions, the blocking pin 48 will then approach one of the blocking protrusions 49, and abut against it when the door panel 1 is pushed beyond the open positions, and the door panel 1 will be prevented from being rotated farther.

In the figures referenced above, pivot hinges 3 are described that comprise both a first ball 37 pressed against the cam member 11 by a first spring 35, and a second ball 38 pressed against the cam member 11 by a second spring 36. The pivot hinge 3 can also, according to an embodiment of the door construction according to the present invention, be implemented without using the second ball 38 and the second spring 36. It should be evident to the person skilled in the art how such a pivot hinge 3 can be implemented. For instance, by making the housing 7 of the pivot hinge shorter on one side of the rotation column 10, i.e., by letting the end of the housing 7 on this side fit more closely to the cam member 11. The releasable cap 44 and/or the opening 28 for the screw 27 of the attachment means for attaching the pivot hinge 3 to the guide profile 4 may herein optionally be retained. However, there is no need then for providing any opening 43 through the cap 44 for the screw 40 of the adjustment means for adjusting the spring pressure of the second spring 36. Furthermore, the second face 13 of the cam member 11 does not necessarily need to be provided with a second recess 16 as a support position for the second ball 38. It should also be clear to the person skilled in the art that a pivot hinge 3 implemented in this way, will function in a similar manner to the pivot hinge 3 described above that employs two balls 37, 38 and two springs 35, 36.

Figure 14:
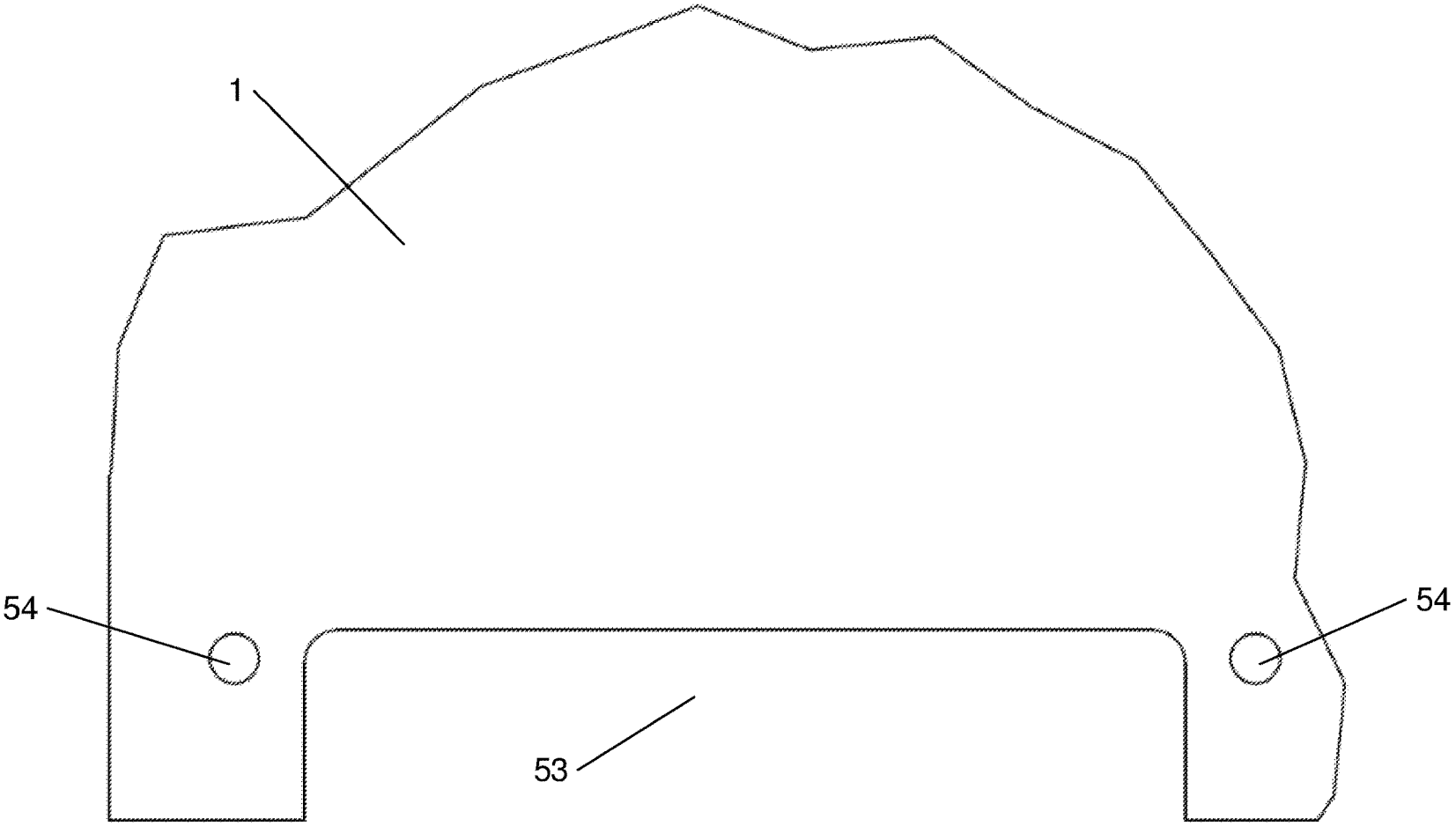
FIG. 14 shows a detail of a door panel provided with a recess for arranging therein a pivot hinge of a door construction according to an embodiment of the present invention.
Figure 15:
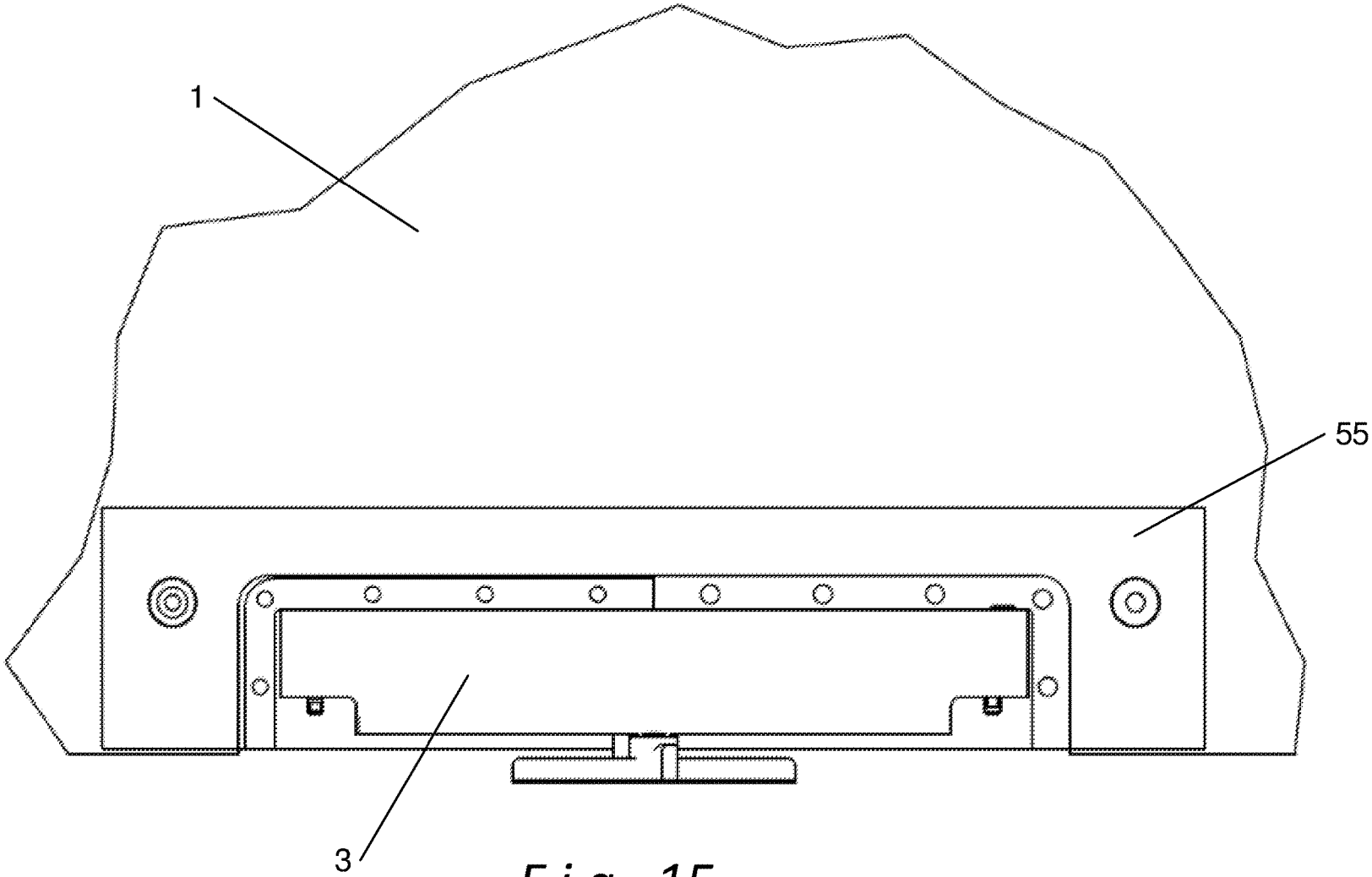
FIG. 15 shows the door panel shown in FIG. 14, wherein a pivot hinge is arranged in the recess provided thereto in the door panel, by means of mounting brackets.
Figure 16:
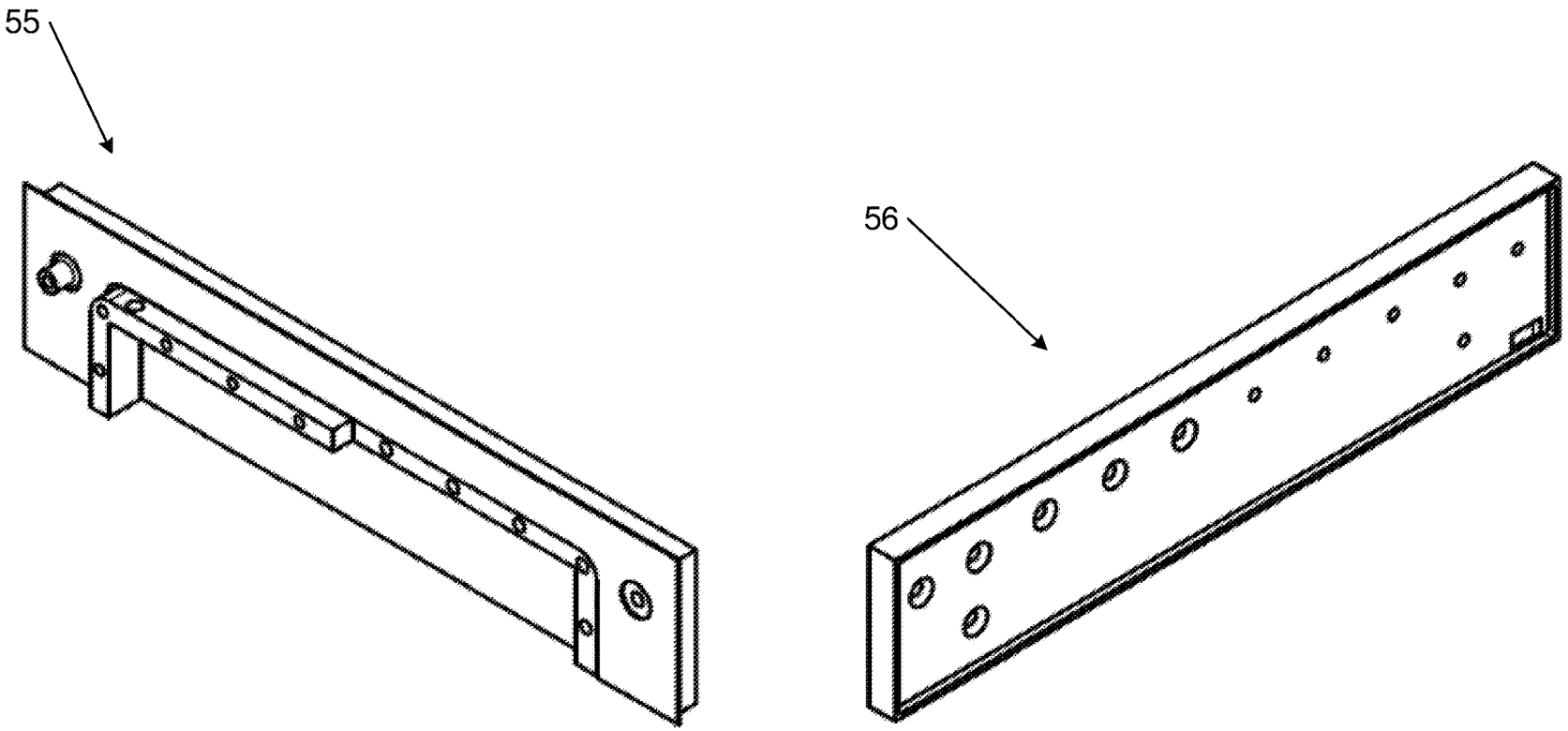
FIG. 16 shows a perspective view of mounting brackets by means of which a pivot hinge is arranged in the recess provided thereto in the door panel shown in FIG. 14.

As mentioned above, the self-closing pivot hinge 3 of the door construction according to an embodiment of the present invention can also be used in door panels 1 not provided with a guide profile 4. Thus, for instance, it is also possible to use the pivot hinge 3 in combination with a door panel 1 that is provided with a recess 53 in which the pivot hinge 3 can be arranged. Shown in FIG. 14 is a detail of a door panel 1 arranged in this way, near the recess 53 for the pivot hinge 3. The door panel 1 shown is also additionally provided with two openings 54 intended to connect two mounting brackets 55, 56 arranged on opposite sides of the door panel 1, shown in FIG. 16, to each other and also to the door panel 1 by means of bolts or other possible connecting elements through the openings 54. These mounting brackets 55, 56 are arranged so that between the interconnected mounting brackets 55, 56, a space is formed through the recess in the door panel 1, in which space the pivot hinge 3 can be placed and secured. All of this is further elucidated in FIG. 15, in which a first mounting bracket 55 is placed on one side against the door panel 1 and the pivot hinge 3 in the recess 53 in the door panel 1. Starting from this arrangement, the second mounting bracket 56 can then be placed against the other side of the door panel 1, and both mounting brackets 55, 56 can be connected to each other by means of bolts or optionally other connecting elements through openings 54 and the mounting brackets 55, 56.

The parts of the door construction according to an embodiment of the present invention, selected from the group consisting of the cam member 11, the cam member retainers 23, the screws 33 for connecting the cam member retainers 23 and the cam member 11, the wall mounting part 29, the wall profile mounting part 31, the blocking pin 48 of the blocking means, the screws 27 for attaching the pivot hinge 3 to the guide profile 4, the releasable cap 44 of the housing 7 and the screws 27 of the adjustment means for adjusting the spring pressure, are preferably manufactured from steel, because of its strength, and more preferably from a rustproof or stainless steel (SST) because of its resistance against corrosion. An example of a stainless steel that may be used is ANSI 304 stainless steel.

The parts from the group mentioned above that during use of the door construction are subjected to large forces, such as the cam member 11, the cam member retainers 23, the screws 33 for connecting the cam member retainers 23 and the cam member 11, the wall mounting part 29, the wall profile mounting part 31 and the blocking pin 48 of the blocking means, are even more preferably manufactured from a duplex rustproof or stainless steel (duplex steel) because of its greater strength and stability, and also because of its even better resistance against corrosion. Duplex steel is a very sturdy alloy that shows no or very little deformation when subjected to large forces. An example of a duplex steel that may be used is CD4MCu duplex stainless steel.

The first ball 37 and the second ball 38 are preferably manufactured from a tempered and stainless steel, in order to limit wear and deformation of the balls 37, 38 as a result of the forces and friction to which they are subjected. An example of a metal alloy that may be used for the balls 37, 38 is ISO3290 chromium steel, which is a metal alloy that is very suitable for use in ball bearings because of its hardness and shape retention.

In an embodiment of the door construction according to the present invention, balls 37, 38 with a diameter of about 21 mm are used.

The first spring 35 and the second spring 36 are preferably manufactured from spring steel, i.e., steel known to the person skilled in the art to be suitable for use in springs. An example of a metal alloy that may be used for the springs 35, 36 is DIN 17223-1 type C steel (EN 10270-1-SH).

Preferably, springs 35, 36 are used that are capable of exerting a force of at least 200 N, preferably of at least 250 N, and even more preferably of at least 300 N. This allows the smooth opening of door panels 1 with dimensions of up to about 2 m by 2.5 m and a weight of about 150 kg. It should however be clear to the person skilled in the art that for smaller door panels 1, springs 35, 36 of smaller strength may also be used.

In an embodiment of the door construction according to the present invention, springs 35, 36 are used with a free length of about 60 mm and with a spring constant of about 23 N/mm. The springs 35, 36 used are compressible up to a maximal allowed length of about 30 mm, wherein the springs exert a force of about 690 N.

The parts of the door construction according to an embodiment of the present invention selected from the group consisting of the guide profile 4 and the housing 7 of the pivot hinge 3 preferably comprise aluminum, and even more preferably anodized aluminum. Using aluminum is advantageous because this material combines a low weight with a high strength, and because of its resistance to corrosion. Furthermore, aluminum is easily molded to the desired shape, such as the shape of the guide profile 4 and the shape of the housing 7 of the pivot hinge 3, by means of extrusion. Using anodized aluminum is advantageous because this means that the surface of the aluminum is provided with an extra wear and corrosion resistant layer. The additional resistance to wear of the anodized aluminum is, for instance, advantageous for limiting wear due to the shifting of the balls 37, 38 and the springs 35, 36 inside the housing. An example of an aluminum allow that may be used is AlMgSi 0.5.

The pressing elements 39 are preferably manufactured from a plastic, and even more preferably from polyoxymethylene (POM). The use of POM is advantageous because of its high hardness, low coefficient of friction and excellent shape retention. Furthermore, POM also offers the advantage of not being affected by lubricants.

The sliding bushings 26 of the rotation column 10 are preferably manufactured from a plastic. An example of a plastic that may be used Iglidus® G, from Igus® GmbH. This is a plastic with a low coefficient of friction that is capable of withstanding high loads and is not affected by lubricants.

FIG. 17 shows an alternative embodiment of the self-closing pivot hinge 3 of the door construction according to an embodiment of the present invention, wherein, contrary to the embodiment discussed above, gas springs 35', 36' are used instead of the cylindrical springs 35, 36. Other than that, the construction of this alternative embodiment of the self-closing pivot hinge 3 is, apart from a few small details, similar to the construction of the embodiment discussed above. By means of the gas springs 35', 36', a substantially constant spring force or spring pressure can be exerted on the first ball 37 and the second ball 38, and on the cam member 11 located between them.

The gas springs 35', 36' are preferably deflatable gas springs 35', 36', provided with a flap or valve that can be opened, in order for a gas that is present in the gas spring 35', 36' for building the spring pressure to be released from the gas spring 35', 36', to lower the spring force or spring pressure. This allows gas springs 35', 36' to be provided that are capable of supplying their maximal spring force, which then, when installed in a door construction according to an embodiment of the present invention, are adjusted to a desired spring force. As a result of this, one single type of the self-closing pivot hinge 3 can advantageously be used for different applications requiring a different spring force from the first spring 35' and the second spring 36' in the self-closing pivot hinge 3. Preferably, the gas springs 35', 36' are arranged to be able to supply a maximal spring force of about 700 N, and to be adjustable to supply a minimal spring force of 50 N.

Preferably, the deflatable gas springs 35', 36' are arranged so that upon opening the valve or flap, a predetermined amount of gas is released from the spring, after which the valve or flap automatically closes again. This allows the spring pressure or spring force to be lowered in a step-by-step fashion, with steps of a predetermined size, which allows the spring force to be finely adjusted and prevents an excessive amount of gas to be released from the gas spring 35', 36'.

Preferably, the gas springs 35, 36' are provided with hydraulic damping, for instance by means of oil provided inside the gas spring 35', 36' in addition to the gas provided for building the spring pressure of the gas spring 35', 36'. The hydraulic damping causes the gas spring 35', 36' to be slowed down at the end of an inward or outward movement. This may for instance be used advantageously to cause a self-closing pivot hinge 3 to slow down a door panel 1 moving towards the closed position in a door opening 2, to prevent swinging or oscillation of the door panel 1 around the closed position.

List of reference numbers:

| | |
|---|---|
| 1 | door panel |
| 2 | door opening |
| 3 | pivot hinge |
| 4 | guide profile |
| 5 | guide profile sliding surface |
| 6 | door panel frame |
| 7 | pivot hinge housing |
| 8 | housing cavity |
| 9 | housing sliding surface |
| 10 | rotation column |
| 11 | cam member |
| 12 | first face |
| 13 | second face |
| 14 | mantle surface |
| 15 | first recess |
| 16 | second recess |
| 17 | mantle surface notch |
| 18 | first support surface |
| 19 | second support surface |
| 20 | cam member protrusion |
| 21 | cam member opening |
| 22 | transition surface |
| 23 | cam member retainer |
| 24 | cam member retainer groove |
| 25 | cam member retainer opening |
| 26 | sliding bushing |
| 27 | attachment means screw |
| 28 | attachment means opening |
| 29 | wall mounting part |
| 30 | attenuation means |
| 31 | wall profile mounting part |
| 32 | wall profile |
| 33 | rotation column screw |
| 34 | rotation column opening |
| 35, 35' | first spring |

-continued

| List of reference numbers: | |
|---|---|
| 36, 36' | second spring |
| 37 | first ball |
| 38 | second ball |
| 39 | pressing element |
| 40 | adjustment means screw |
| 41 | screw head |
| 42 | groove in screw head |
| 43 | adjustment means screw opening |
| 44 | releasable cap |
| 45 | cap opening |
| 46 | circumferential recess |
| 47 | lubricant opening |
| 48 | blocking pin |
| 49 | blocking protrusion |
| 50 | blocking pin opening |
| 51 | cap housing opening |
| 52 | cap screw |
| 53 | door panel recess |
| 54 | door panel openings |
| 55 | first mounting bracket |
| 56 | second mounting bracket |

The invention claimed is:

1. A self-closing pivot hinge (3) for a door construction comprising a door panel (1) and the pivot hinge (3) for rotatably suspending the door panel (1) in a door opening (2), wherein the pivot hinge (3) is integrated into the door panel (1) at a side of the door panel (1) selected from the top side of the door panel (1) and the bottom side of the door panel (1), the pivot hinge (3) comprising:

an elongated housing (7), attachment means for attaching the pivot hinge (3) to the door panel (1);

a rotation column (10), arranged to be mounted to a wall of the door opening (2) opposite the respective side of the door panel (1) into which the at least one pivot hinge (3) is integrated, wherein the housing (7) is mounted rotatably around the rotation column (10), so that the housing (7) is rotatable in relation to the rotation column (10) from a closed position, which defines a position in which the door panel (1) suspended by the pivot hinge (3) closes the door opening (2), in a first direction, to a first open position, and/or in a second direction opposite to the first direction, to a second open position;

a first spring (35, 35'), extending inside the housing (7) along a lengthwise direction of the housing (7) and conferring a self-closing function to the pivot hinge (3);

a cam member (11), being part of the rotation column (10), and a first spherical ball (37), being urged against the cam member (11) by means of the first spring (35), wherein the cam member (11) is shaped to provide support positions (15, 17) in which the first ball (37) rests in the open and closed positions, and wherein the first ball (37), under the influence of the spring pressure from the first spring (35, 35'), is urged, from substantially every position other than the support positions (15, 16), in the direction of the support position (15, 16) corresponding to the closed position, wherein the cam member (11) is a body comprising a first face (12) and a second face (13), positioned opposite each other, and a mantle surface (14) connecting the first face (12) and the second face (13), wherein the support positions (17) corresponding to the open positions are provided by two notches (17) at opposite positions on the mantle surface (14) of the cam member (11), wherein for the first ball (37), the support position (15) corresponding to the closed position is provided by a first recess (15) on the first face (12) of the cam member (11), wherein the first face (12) of the cam member (11) is provided as a convex surface in a primary direction extending along the support positions on the mantle surface (14) of the cam member (11), wherein the first face (12) of the cam member (11) is provided as a concave surface in a secondary direction substantially perpendicular to the primary direction.

2. The self-closing pivot hinge (3) according to claim 1, wherein the pivot hinge (3) further comprises:

a second spring (36, 36'), extending inside the housing (7) along the lengthwise direction of the housing (7), wherein the first and the second spring (36, 36') are located at opposite sides of the rotation column (10); and a second spherical ball (38), being urged against the cam member (11) by means of the second spring (36, 36'), wherein the cam member (11) is further shaped to provide support positions (16, 17) in which the second ball (38) rests in the open and closed positions, and wherein the second ball (38), under the influence of the spring pressure from the second spring (36, 36'), is urged, from substantially every position other than the support positions (16, 17), in the direction of the support position (16) corresponding to the closed position, wherein for the second ball (38), the support position (16) corresponding to the closed position is provided by a second recess (16) on the second face (13) of the cam member (11), wherein the second face (13) of the cam member (11) is provided as a convex surface in the primary direction, wherein the second face (13) of the cam member (11) is provided as a concave surface in the secondary direction.

3. The self-closing pivot hinge (3) according to claim 2, wherein the first recess (15) is arranged so that the first ball (37) is capable of being lowered into the first recess (15) until halfway through the cam member (11), and the second recess (16) is arranged so that the second ball (38) is capable of being lowered into the second recess (16) until halfway through the cam member (11).

4. The self-closing pivot hinge (3) according to claim 2, wherein the first recess (15) is provided at its circumference with a first support surface (18) for the first ball (37), and the second recess (16) is provided at its circumference with a second support surface (19) for the second ball (38).

5. The self-closing pivot hinge (3) according to claim 4, wherein the first support surface (18) has a shape which is complementary to the shape of the first ball (37), and the second support surface (19) has a shape which is complementary to the shape of the second ball (38).

6. The self-closing pivot hinge (3) according to claim 2, wherein the transition between the first face (12) and the mantle surface (14) of the cam member (11) in the proximity of the support positions (17) on the mantle surface (14) is provided with a transition surface (22) to facilitate the transition of the first ball (37) between the first face (12) and the mantle surface (14), and the transition between the second face (13) and the mantle surface (14) of the cam member (11) in the proximity of the support positions (17) on the mantle surface (14) is provided with a transition surface (22) to facilitate the transition of the second ball (38) between the second face (13) and the mantle surface (14).

7. The self-closing pivot hinge (3) according to claim 6, wherein the transition surface (22) is a convex surface.

8. The self-closing pivot hinge (3) according to claim 2, wherein the pivot hinge (3) comprises a first adjustment means (40) for adjusting the spring pressure of the first spring (35, 35'), and wherein the pivot hinge (3) comprises a second adjustment means (40) for adjusting the spring pressure of the second spring (36, 36').

9. The self-closing pivot hinge (3) according to claim 8, wherein the adjustment means (40) comprises a screw (40), which is screwably arranged in an opening (44) through the housing (7), and which is arranged to press against the end of the spring (35, 36; 35', 36') located opposite the end of the spring (35, 36; 35', 36') pressing against the ball (37, 38), so that the spring pressure is adjustable by screwing the screw (40) through the opening (44) in the housing (7).

10. The self-closing pivot hinge (3) according claim 9, wherein a head (41) of the screw (40) has a shape which is laterally engageable, so that the head (41) of the screw (40) is rotatable from a lateral position for screwing the screw (40) through the opening (44) in the housing (7).

11. The self-closing pivot hinge (3) according to claim 10, wherein the head (41) of the screw (40) is laterally engageable by means of grooves (42) in the side of the head (41) of the screw (40), said grooves (42) being oriented along the lengthwise direction of the screw (40).

12. The self-closing pivot hinge (3) according to claim 9, wherein the opening (44) in the housing (7) for the screw (40) of the adjustment means (40) is provided through a releasable cap (44) of the housing (7).

13. The self-closing pivot hinge (3) according to claim 2, wherein each of the first spring (35') and the second spring (36') is a gas spring.

14. The self-closing pivot hinge (3) according to claim 13, wherein each gas spring (35', 36') is a deflatable gas spring (35', 36'), arranged for releasing gas from the gas spring (35', 36') to lower the spring force of the gas spring (35', 36').

15. The self-closing pivot hinge (3) according to claim 14, wherein each deflatable gas spring (35', 36') is arranged for releasing a predetermined amount of gas from the gas spring (35', 36') for lowering the spring force of the gas spring (35', 36') step by step.

16. The self-closing pivot hinge (3) according to claim 15, wherein each gas spring (35', 36') is provided with a hydraulic attenuation means.

17. The self-closing pivot hinge (3) according to claim 1, wherein the cam member (11) is symmetrical in the direction perpendicular to the first face (12) and the second face (13), and wherein the cam member (11) is symmetrical in the direction extending along the support positions (17) on the mantle surface (14) of the cam member (11).

18. The self-closing pivot hinge (3) according to claim 1, wherein the housing (7) is provided with at least one closable opening (47) for introducing a lubricant into the housing (7).

19. The self-closing pivot hinge (3) according to claim 1, wherein the pivot hinge (3) comprises blocking means (48, 49), arranged for preventing the rotation of the door panel (1) beyond the open positions and in a direction away from the closed position.

20. A door construction comprising a door panel (1) and at least one self-closing pivot hinge (3) according to claim 1, for rotatably suspending the door panel (1) in a door opening (2), wherein the at least one pivot hinge (3) is integrated into the door panel (1) at a side of the door panel (1) selected from the top side of the door panel (1) and the bottom side of the door panel (1).

21. The door construction according to claim 20, wherein the door panel (1) comprises a guide profile (4), extending along substantially the entire side of the door panel (1) provided with the at least one pivot hinge (3), wherein the at least one pivot hinge (3) is slidably arranged in said guide profile (4), and wherein attachment means (27) of the at least one pivot hinge (3) are provided for releasably attaching the at least one pivot hinge (3) to the guide profile (4).

22. The door construction according to claim 21, wherein the housing (7) of the at least one pivot hinge (3) is shaped to provide a first sliding surface (9) and a second sliding surface (9), said sliding surfaces (9) being provided to slide over complementary sliding surfaces (5) in the lengthwise direction and over substantially the entire length of the guide profile (4) when sliding the at least one pivot hinge (3) in the guide profile (4).

23. The door construction according to claim 21, wherein the guide profile (4) is part of a frame (6) at the circumference of the door panel (1).

* * * * *